US009896176B2

(12) United States Patent
Suzuki et al.

(10) Patent No.: US 9,896,176 B2
(45) Date of Patent: Feb. 20, 2018

(54) MARINE PROPULSION DEVICE

(71) Applicant: YAMAHA HATSUDOKI KABUSHIKI KAISHA, Shizuoka-ken (JP)

(72) Inventors: Takayoshi Suzuki, Shizuoka-Ken (JP); Noriyoshi Hiraoka, Shizuoka-Ken (JP); Akihiro Onoue, Shizuoka-Ken (JP); Atsushi Kumita, Shizuoka-Ken (JP); Yoshiaki Tasaka, Shizuoka-Ken (JP)

(73) Assignee: YAMAHA HATSUDOKI KABUSHIKI KAISHA, Iwata-shi, Shizuoka-ken (JP)

( * ) Notice: Subject to any disclaimer, the term of this patent is extended or adjusted under 35 U.S.C. 154(b) by 0 days.

(21) Appl. No.: 14/746,096

(22) Filed: Jun. 22, 2015

(65) Prior Publication Data

US 2016/0090165 A1 Mar. 31, 2016

(30) Foreign Application Priority Data

Sep. 30, 2014 (JP) ..... 2014-199929

(51) Int. Cl.
*B63H 21/21* (2006.01)
*B63H 21/22* (2006.01)
(Continued)

(52) U.S. Cl.
CPC ..... *B63H 20/20* (2013.01); *B63H 20/12* (2013.01); *B63H 2025/024* (2013.01)

(58) Field of Classification Search
CPC ..... B63H 20/00; B63H 20/12; B63H 20/20; B63H 21/21; B63H 21/213; B63H 21/26;
(Continued)

(56) References Cited

U.S. PATENT DOCUMENTS 5,421,755 A * 6/1995 Kakizaki ..... B63H 21/213 440/63
5,453,030 A * 9/1995 Broussard ..... B63H 21/265 114/144 R
(Continued)

FOREIGN PATENT DOCUMENTS

JP S59-45296 A 3/1984
JP 2007-153241 A 6/2007
JP 2014-046745 A 3/2014

*Primary Examiner* — Daniel V Venne
(74) *Attorney, Agent, or Firm* — Rabin & Berdo, P.C.

(57) ABSTRACT

A marine propulsion device includes a power source, a steering handle, and an accelerator grip that moves with respect to the steering handle. A movement region of the accelerator grip includes a forward movement rotation region, a reverse movement rotation region and an axis movement region. In the forward movement rotation region, the accelerator grip is operated to rotate so as to obtain a drive force in a forward movement direction. In the reverse movement rotation region the accelerator grip is operated to rotate so as to obtain a drive force in a reverse movement direction. The axis movement region is provided between the forward movement rotation region and the reverse movement rotation region. In the axis movement region, the accelerator grip is moved in the extensional direction of a rotation axis.

20 Claims, 11 Drawing Sheets

FIRST EMBODIMENT

(51) Int. Cl.

| | |
|---|---|
| ***B60W 10/04*** | (2006.01) |
| ***B63H 20/20*** | (2006.01) |
| ***B63H 20/12*** | (2006.01) |
| *B63H 25/02* | (2006.01) |

(58) Field of Classification Search
CPC . B63H 21/265; B63H 2020/00; B63H 21/216
USPC ..... 440/87
See application file for complete search history.

(56) References Cited

U.S. PATENT DOCUMENTS

| | | | | | |
|---|---|---|---|---|---|
| 5,545,064 | A * | 8/1996 | Tsunekawa | F02B 61/045 | 440/53 |
| 5,564,956 | A * | 10/1996 | McDavid | B63H 20/007 | 114/146 |
| 5,797,777 | A * | 8/1998 | Tsunekawa | B63H 21/265 | 440/84 |
| 6,093,066 | A * | 7/2000 | Isogawa | B63H 21/265 | 440/63 |
| 6,491,555 | B2 * | 12/2002 | Kitsu | B63H 21/22 | 440/87 |
| 7,331,834 | B2 * | 2/2008 | Yasuda | B63H 20/00 | 440/87 |
| 8,257,122 | B1 * | 9/2012 | Holley | B63H 21/213 | 440/87 |
| 2004/0152375 | A1 * | 8/2004 | Takada | F02B 75/22 | 440/86 |
| 2006/0003644 | A1 * | 1/2006 | Okabe | B63H 20/08 | 440/63 |

* cited by examiner

FIRST EMBODIMENT

VII-VII CROSS-SECTION

FIG.9
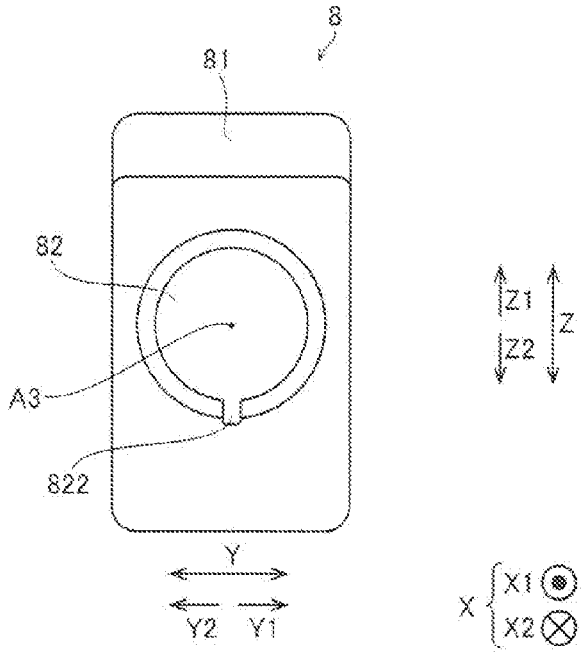
FIG.10 SECOND EMBODIMENT
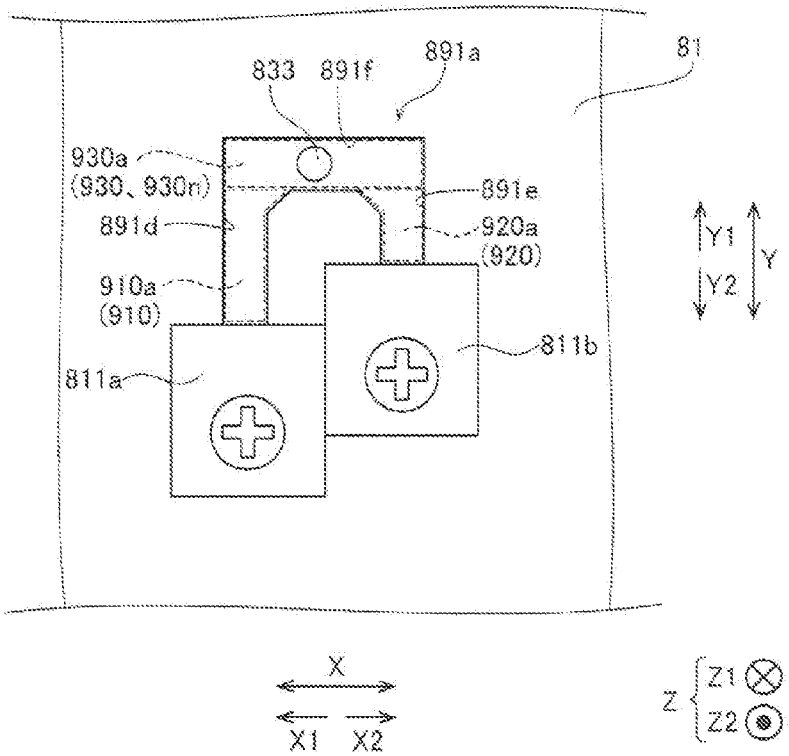

FIG. 11 OPERATION OF ACCELERATOR GRIP (SECOND EMBODIMENT)
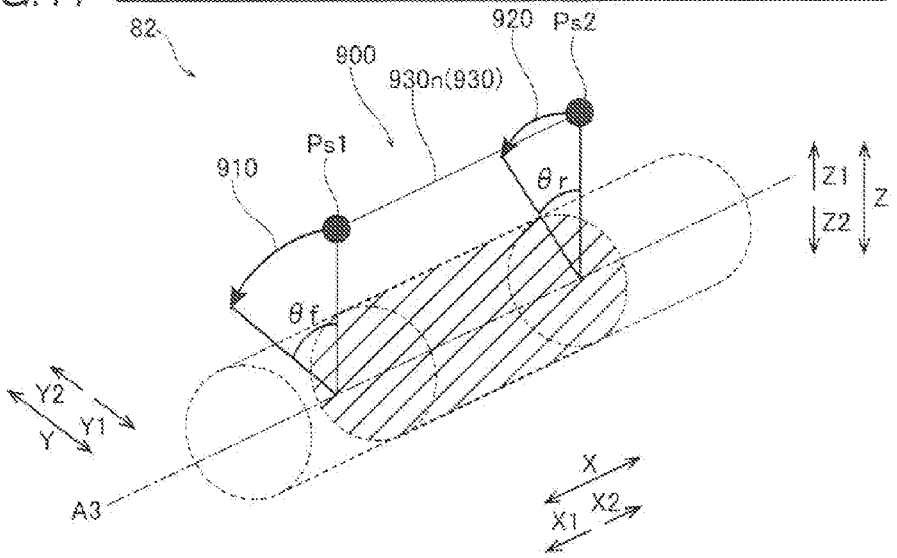
FIG. 12 THIRD EMBODIMENT
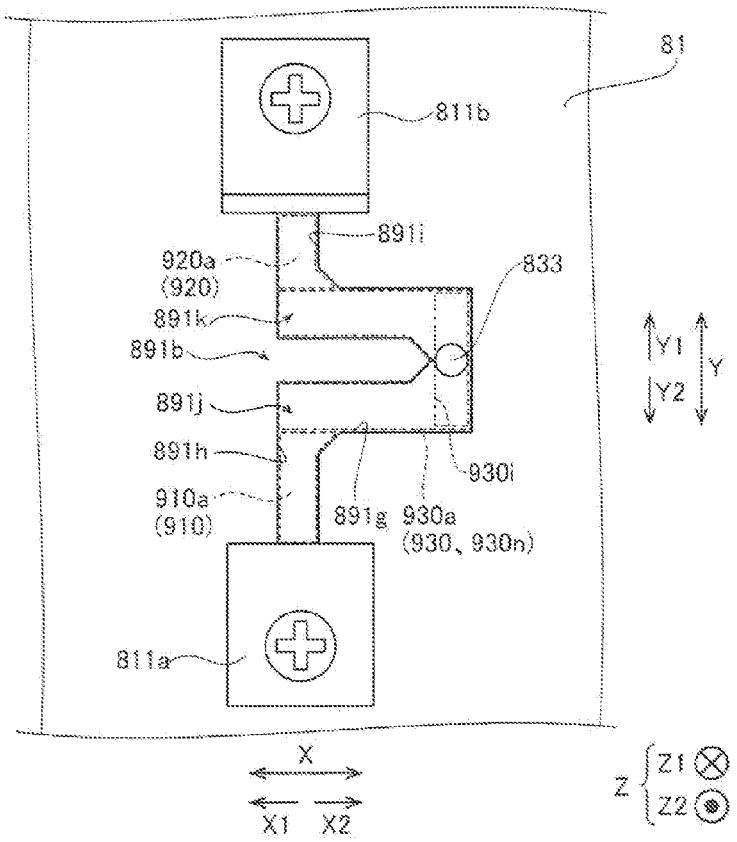

FIG. 13 OPERATION OF ACCELERATOR GRIP (THIRD EMBODIMENT)
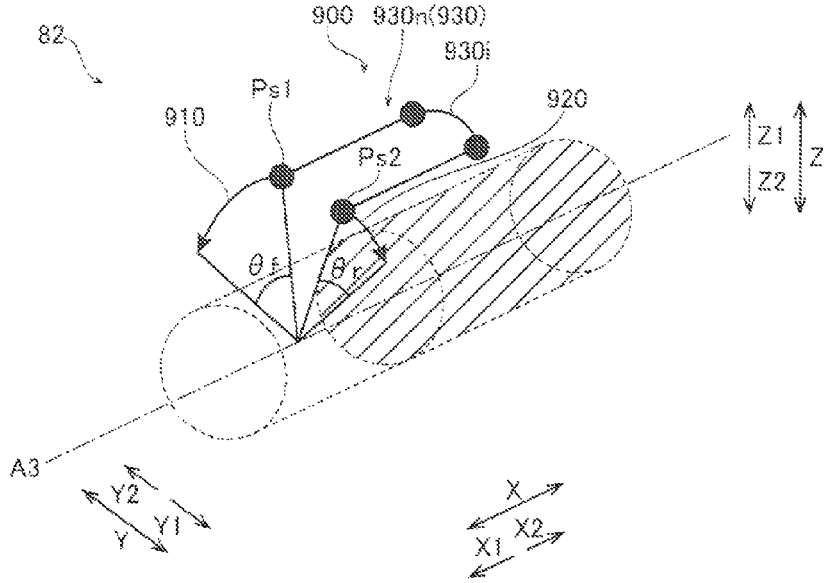
FIG. 14
FOURTH EMBODIMENT
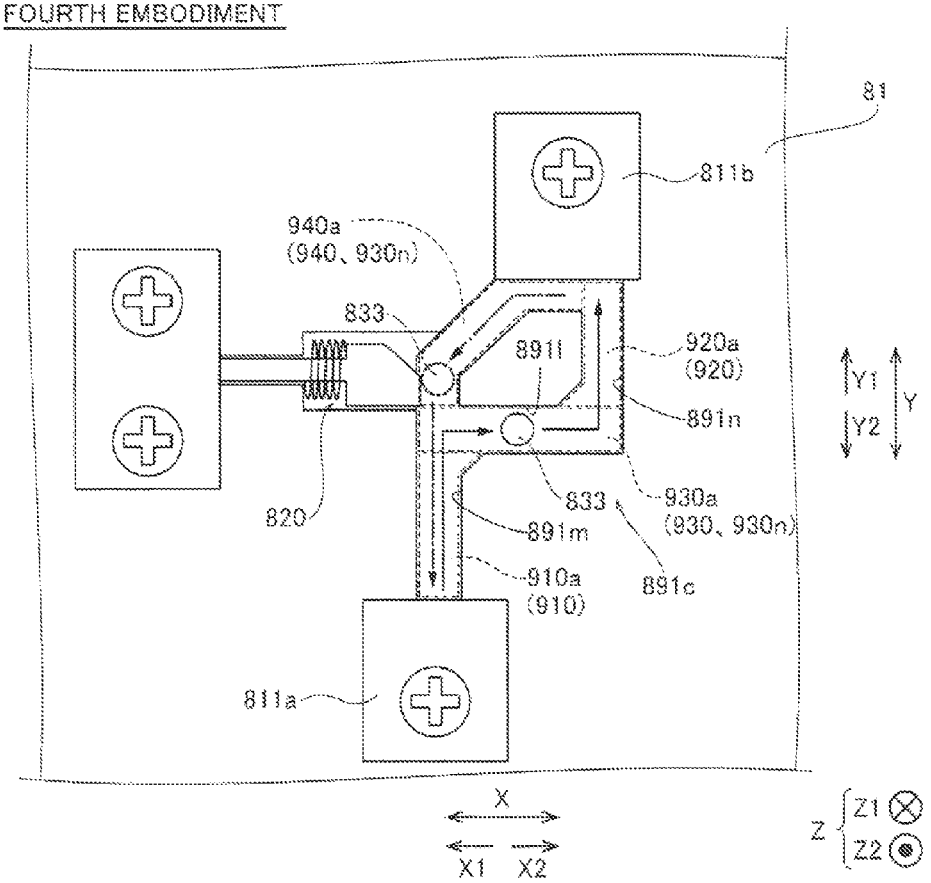

FIG. 15
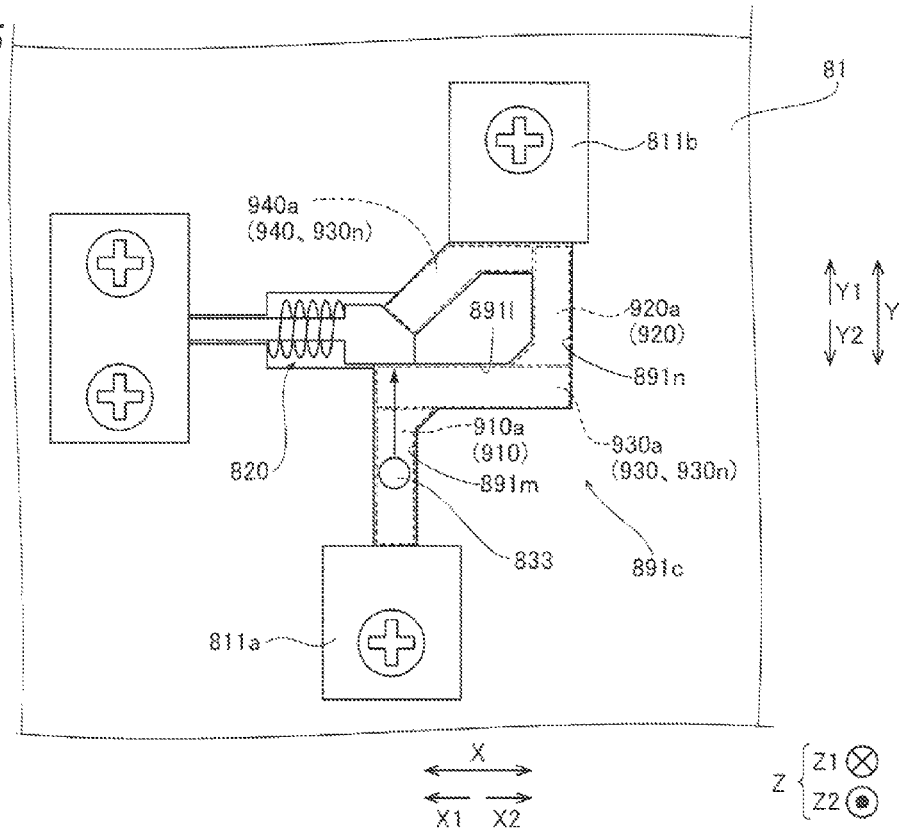
FIG. 16 OPERATION OF ACCELERATOR GRIP (FOURTH EMBODIMENT)
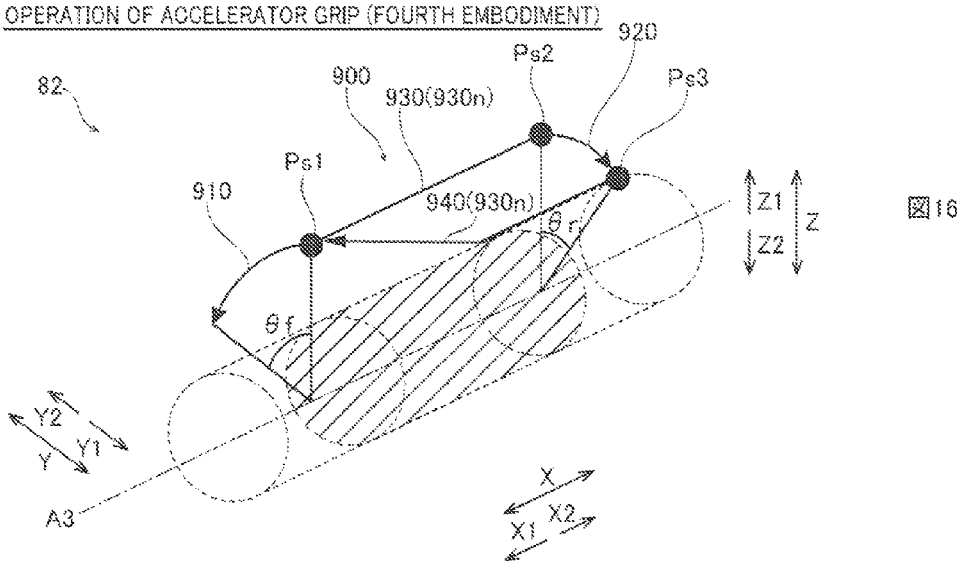
図16

MARINE PROPULSION DEVICE

CROSS-REFERENCE TO RELATED APPLICATION

The priority application number JP2014-199929, Marine Propulsion Device, Sep. 30, 2014, Takayoshi Suzuki, Noriyoshi Hiraoka, Akihiro Onoue, Atsushi Kumita, and Yoshiaki Tasaka, upon which this patent application is based is hereby incorporated by reference.

BACKGROUND OF THE INVENTION

Field of the Invention

The present invention relates to a marine propulsion device, and more particularly, it relates to a marine propulsion device including an accelerator grip.

Description of the Background Art

A marine propulsion device including an accelerator grip is known in general. Such a marine propulsion device is disclosed in Japanese Patent Laying-Open No. 2014-046745, for example.

In general, a marine propulsion device is provided with an accelerator grip to adjust drive force in a forward movement direction or in a reverse movement direction generated from a power source. When finely adjusting forward/reverse movement of a boat body, a user repeats an operation of switching the accelerator grip from a rotatable state in one of a forward movement rotation region and a reverse movement rotation region to a rotatable state in the other of the forward movement rotation region and the reverse movement rotation region. In this case, there is a time lag until the boat body responds to the operation of switching the accelerator grip. Therefore, it is difficult for the user to recognize that the accelerator grip has been switched from the rotatable state in one of the forward movement rotation region and the reverse movement rotation region to the rotatable state in the other of the forward movement rotation region and the reverse movement rotation region. The aforementioned Japanese Patent Laying-Open No. 2014-046745 is known to solve this problem.

The aforementioned Japanese Patent Laying-Open No. 2014-046745 discloses a marine propulsion device including a power source, a steering handle that extends forward with respect to the power source, and an accelerator grip movably mounted on the steering handle. A movement region of the accelerator grip includes a forward movement rotation region where the accelerator grip is operated to rotate about a rotation axis so as to obtain drive force in a forward movement direction from the power source and a reverse movement rotation region where the accelerator grip is operated to rotate about the rotation axis so as to obtain drive force in a reverse movement direction from the power source. A shaft portion of the steering handle is provided with an engaging member that engages with the accelerator grip. The accelerator grip is not allowed to rotate in the forward movement rotation region and the reverse movement rotation region in a state where the accelerator grip and the engaging member engage with each other. A user presses down the engaging member while griping the accelerator grip. When the user presses down the engaging member, engagement between the accelerator grip and the engaging member is released, and the accelerator grip is allowed to rotate. Thus, when the accelerator grip is switched from a rotatable state in one of the forward movement rotation region and the reverse movement rotation region to a rotatable state in the other of the forward movement rotation region and the reverse movement rotation region, the accelerator grip engages with the engaging member to be temporarily fixed, and hence the user recognizes that the rotation region of the accelerator grip is switched by releasing this engagement. In the marine propulsion device described in the aforementioned Japanese Patent Laying-Open No. 2014-046745, however, it is necessary to release the engagement between the accelerator grip and the engaging member when the accelerator grip is switched from the rotatable state in one of the forward movement rotation region and the reverse movement rotation region to the rotatable state in the other of the forward movement rotation region and the reverse movement rotation region. Thus, although the user recognizes that the rotation region of the accelerator grip is switched, an operation of switching the accelerator grip from the rotatable state in one of the forward movement rotation region and the reverse movement rotation region to the rotatable state in the other of the forward movement rotation region and the reverse movement rotation region is complicated, and it is difficult for the user to smoothly perform the operation of switching the rotation region of the accelerator grip.

SUMMARY OF THE INVENTION

The present invention has been proposed in order to solve the aforementioned problem, and an object of the present invention is to provide a marine propulsion device that significantly reduces or prevents complication of an operation of switching a rotation region of an accelerator grip and allows a user to smoothly perform the operation of switching the rotation region of the accelerator grip while allowing the user to recognize that the rotation region of the accelerator grip is switched.

A marine propulsion device according to an aspect of the present invention includes a power source, a steering handle that extends forward with respect to the power source, and an accelerator grip movably mounted on the steering handle. A movement region of the accelerator grip includes a forward movement rotation region where the accelerator grip is operated to rotate about a rotation axis so as to obtain drive force in a forward movement direction from the power source, a reverse movement rotation region where the accelerator grip is operated to rotate about the rotation axis so as to obtain drive force in a reverse movement direction from the power source, and an axis movement region provided between the forward movement rotation region and the reverse movement rotation region, where the accelerator grip is moved in the extensional direction of the rotation axis.

In the marine propulsion device according to this aspect of the present invention, as hereinabove described, the movement region of the accelerator grip includes the axis movement region where the accelerator grip is moved in the extensional direction of the rotation axis between the forward movement rotation region and the reverse movement rotation region. Thus, the accelerator grip is switched from a rotationally operable state in one of the forward movement rotation region and the reverse movement rotation region to a rotationally operable state in the other of the forward movement rotation region and the reverse movement rotation region through the axis movement region, unlike the structure in which it is necessary to release an engaging state between the accelerator grip and an engaging member when the accelerator grip is switched from the rotationally operable state in one of the forward movement rotation region and the reverse movement rotation region to the rotationally operable state in the other of the forward movement rotation region and the reverse movement rotation region. In this case, complication of an operation of switching the rotation region of the accelerator grip is significantly reduced or prevented, and a user smoothly performs the operation of switching the rotation region of the accelerator grip while recognizing that the rotation region of the accelerator grip is switched. Consequently, the operability is improved when the user switches the rotation region of the accelerator grip.

Furthermore, the marine propulsion device is configured as hereinabove described, whereby when the accelerator grip is switched from the rotationally operable state in one of the forward movement rotation region and the reverse movement rotation region to the rotationally operable state in the other of the forward movement rotation region and the reverse movement rotation region, restriction of the posture of the user (restriction of a gripped position of the accelerator grip) is significantly reduced when the user operates the accelerator grip, unlike the structure in which it is necessary for the user to grip a position of the accelerator grip where the engaging state between the accelerator grip and the engaging member is released.

In the aforementioned marine propulsion device according to this aspect, the forward movement rotation region and the reverse movement rotation region are preferably arranged at positions different from each other in the extensional direction of the rotation axis. According to this structure, the forward movement rotation region and the reverse movement rotation region are arranged separately in the extensional direction of the rotation axis, and hence the user easily recognizes the forward movement rotation region and the reverse movement rotation region on the basis of a difference in the position in the extensional direction of the rotation axis.

In this case, the forward movement rotation region and the reverse movement rotation region are preferably arranged not to overlap each other, as viewed in the extensional direction of the rotation axis, and the rotation direction of the accelerator grip is preferably opposite in the forward movement rotation region and the reverse movement rotation region. According to this structure, the user more easily recognizes the forward movement rotation region and the reverse movement rotation region, unlike the case where the rotation direction of the accelerator grip is the same in the forward movement rotation region and the reverse movement rotation region. Furthermore, the user more easily recognizes the forward movement rotation region and the reverse movement rotation region on the basis of a difference in the position about the rotation axis.

In the aforementioned structure in which the forward movement rotation region and the reverse movement rotation region are arranged at the positions different from each other in the extensional direction of the rotation axis, the forward movement rotation region and the reverse movement rotation region are preferably arranged to overlap each other, as viewed in the extensional direction of the rotation axis, and the rotation direction of the accelerator grip is preferably the same in the forward movement rotation region and the reverse movement rotation region. According to this structure, a space (rotation angle range) where the forward movement rotation region and the reverse movement rotation region are arranged is reduced in size, as viewed in the extensional direction of the rotation axis, unlike the case where the rotation direction of the accelerator grip is opposite in the forward movement rotation region and the reverse movement rotation region.

In the aforementioned marine propulsion device according to this aspect, the axis movement region preferably includes a neutral region where no drive force in the forward movement direction or in the reverse movement direction is generated. According to this structure, unless the accelerator grip passes through the neutral region, the accelerator grip does not rotate from one of the forward movement rotation region and the reverse movement rotation region into the other of the forward movement rotation region and the reverse movement rotation region. Consequently, complication of the operation of switching the rotation region of the accelerator grip is significantly reduced or prevented, and the user smoothly performs the operation of switching the rotation region of the accelerator grip while recognizing that a state of forward movement drive or reverse movement drive switches to a state of opposite drive. Furthermore, the extra load on the power source is significantly reduced or prevented when the state of forward movement drive or reverse movement drive switches to the state of opposite drive.

In the aforementioned marine propulsion device according to this aspect, the forward movement rotation region and the reverse movement rotation region are preferably provided at substantially the same positions in the extensional direction of the rotation axis, the rotation direction of the accelerator grip is preferably opposite in the forward movement rotation region and the reverse movement rotation region, and the accelerator grip is preferably switched from a rotationally operable state in the forward movement rotation region to a rotationally operable state in the reverse movement rotation region through the axis movement region. According to this structure, even when the forward movement rotation region and the reverse movement rotation region are not arranged separately in the extensional direction of the rotation axis, the user easily recognizes the forward movement rotation region and the reverse movement rotation region by setting the rotation direction of the accelerator grip to be opposite in the forward movement rotation region and the reverse movement rotation region. Furthermore, unlike the case where the forward movement rotation region and the reverse movement rotation region of the accelerator grip are arranged separately in the extensional direction of the rotation axis, a space (the length in the extensional direction of the rotation axis) where the forward movement rotation region and the reverse movement rotation region are arranged is reduced in size in a plan view.

In this case, the forward movement rotation region and the reverse movement rotation region are preferably separated from each other by the axis movement region. According to this structure, even when the forward movement rotation region and the reverse movement rotation region are not arranged separately in the extensional direction of the rotation axis, the user more easily recognizes the forward movement rotation region and the reverse movement rotation region by the separation of the forward movement rotation region from the reverse movement rotation region by the axis movement region.

In the aforementioned structure in which the forward movement rotation region and the reverse movement rotation region are separated from each other by the axis movement region, the accelerator grip is preferably switched from the rotationally operable state in the forward movement rotation region to the rotationally operable state in the reverse movement rotation region through a neutral rotation region offset in the extensional direction of the rotation axis with respect to the forward movement rotation region and the reverse movement rotation region. According to this structure, complication of the operation of switching the rotation region of the accelerator grip is significantly reduced or prevented, and the user smoothly performs the operation of switching the rotation region of the accelerator grip while recognizing that the accelerator grip is switched from the rotationally operable state in the forward movement rotation region to the rotationally operable state in the reverse movement rotation region through the neutral rotation region.

In the aforementioned marine propulsion device according to this aspect, the accelerator grip is preferably switched from a rotationally operable state in the forward movement rotation region to a rotationally operable state in the reverse movement rotation region through the axis movement region, and is preferably switched from the rotationally operable state in the reverse movement rotation region to the rotationally operable state in the forward movement rotation region not through the axis movement region. According to this structure, complication of the operation of switching the rotation region of the accelerator grip from the forward movement rotation region to the reverse movement rotation region is significantly reduced or prevented, and the user smoothly performs the operation of switching the rotation region of the accelerator grip. Furthermore, the accelerator grip is easily switched from the rotationally operable state in the reverse movement rotation region to the rotationally operable state in the forward movement rotation region without a complicated operation.

In the aforementioned marine propulsion device according to this aspect, the maximum rotational operation angle of the accelerator grip in the forward movement rotation region is preferably larger than the maximum rotational operation angle of the accelerator grip in the reverse movement rotation region. According to this structure, the user easily recognizes whether the accelerator grip has rotated into the forward movement rotation region or the reverse movement rotation region and easily finely adjusts an output for forward movement.

In the aforementioned marine propulsion device according to this aspect, the axis movement region preferably includes a neutral region where no drive force in the forward movement direction or in the reverse movement direction is generated, and the marine propulsion device preferably further includes an urging member that urges the accelerator grip so as to locate the accelerator grip in the neutral region. According to this structure, the accelerator grip is located in the neutral region even when the user releases his/her hand from the accelerator grip in the case where the power source generates no output in the forward movement rotation region and the reverse movement rotation region.

In the aforementioned marine propulsion device according to this aspect, the power source is preferably an electric motor. According to this structure, in the marine propulsion device in which the electric motor is employed as the power source, complication of the operation of switching the rotation region of the accelerator grip is significantly reduced or prevented, and the user smoothly performs the operation of switching the rotation region of the accelerator grip while recognizing that the rotation region of the accelerator grip is switched.

The aforementioned marine propulsion device according to this aspect preferably further includes a shaft member connected to the accelerator grip and a steering handle housing that supports the shaft member, the shaft member preferably includes a first engaging portion, the steering handle housing preferably includes a second engaging portion that engages with the first engaging portion, and in a state where the first engaging portion of the shaft member and the second engaging portion of the steering handle housing engage with each other, the shaft member preferably moves in the extensional direction of the rotation axis with respect to the steering handle housing in a first engaging region that corresponds to the axis movement region, and preferably rotates about the rotation axis with respect to the steering handle housing in a second engaging region that corresponds to the forward movement rotation region and a third engaging region that corresponds to the reverse movement rotation region. According to this structure, the accelerator grip rotates and axially moves in the state where the first engaging portion of the shaft member and the second engaging portion of the steering handle housing engage with each other, and hence the first engaging portion of the shaft member is guided by the second engaging portion of the steering handle housing and is moved to a prescribed position. Consequently, the accelerator grip is accurately operated.

The foregoing and other objects, features, aspects, and advantages of the present invention will become more apparent from the following detailed description of the present invention when taken in conjunction with the accompanying drawings.

BRIEF DESCRIPTION OF THE DRAWINGS

FIG. 9 is a side elevational view of the accelerator grip of the marine propulsion device according to the first embodiment of the present invention, as viewed in the extensional direction of a rotation axis;

FIG. 10 is a diagram schematically showing an engaging state between a first engaging portion and a second engaging portion of a marine propulsion device according to a second embodiment of the present invention, as viewed in a direction *Z*2;

FIG. 11 is a diagram schematically showing the operation of an accelerator grip of the marine propulsion device according to the second embodiment of the present invention;

FIG. 12 is a diagram schematically showing an engaging state between a first engaging portion and a second engaging portion of a marine propulsion device according to a third embodiment of the present invention, as viewed in a direction Z2;

FIG. 13 is a diagram schematically showing the operation of an accelerator grip of the marine propulsion device according to the third embodiment of the present invention;

FIG. 14 is a diagram schematically showing an engaging state between a first engaging portion and a second engaging portion of a marine propulsion device according to a fourth embodiment of the present invention, as viewed in a direction Z2;

FIG. 15 is another diagram schematically showing the engaging state between the first engaging portion and the second engaging portion of the marine propulsion device according to the fourth embodiment of the present invention, as viewed in the direction Z2;

FIG. 16 is a diagram schematically showing the operation of an accelerator grip of the marine propulsion device according to the fourth embodiment of the present invention.

DESCRIPTION OF THE PREFERRED EMBODIMENT

Embodiments of the present invention are hereinafter described with reference to the drawings.

First Embodiment

The structure of a marine propulsion device 1 according to a first embodiment of the present invention is now described with reference to FIGS. 1 to 9. In the figure, arrow FWD represents the forward movement direction of a boat body, and arrow BWD represents the reverse movement direction of the boat body.

Figure 1:
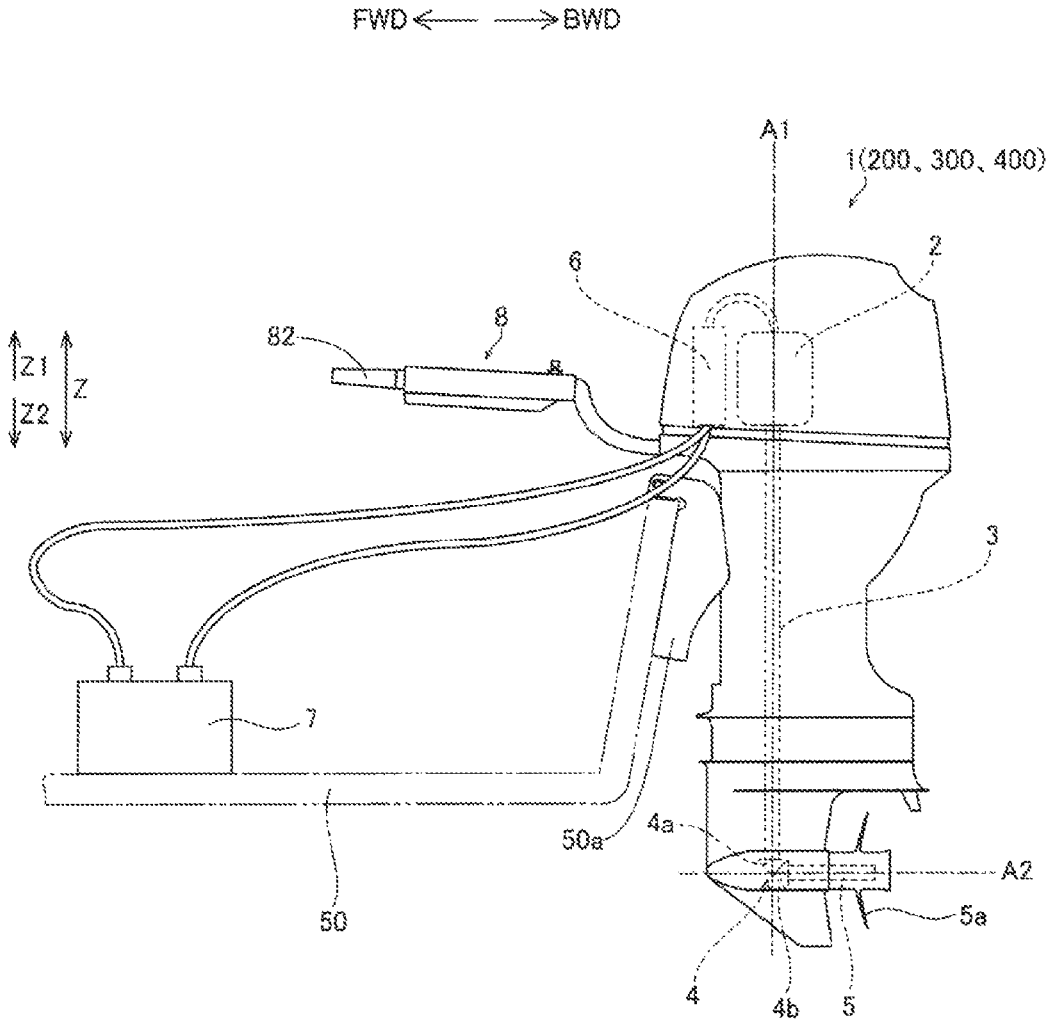
FIG. 1 is a diagram for illustrating the overall structure of a marine propulsion device according to a first embodiment of the present invention.

As shown in FIG. 1, the marine propulsion device 1 includes a power source 2, a drive shaft 3, a gear portion 4, a propeller shaft 5, and an ECU (engine control unit) 6. Electric power is supplied from a battery 7 arranged in a boat body 50 to the power source 2 and the ECU 6. The marine propulsion device 1 also includes a steering handle 8. The marine propulsion device 1 is mounted on the boat body 50 through a bracket 50*a*.

The power source 2 includes a normally and reversely rotatable electric motor.

An upper end of the drive shaft 3 is connected to the power source 2. A lower end of the drive shaft 3 is mounted with a pinion gear 4*a* described later. The drive shaft 3 is rotated about a rotation axis A1 following the drive of the power source 2.

The gear portion 4 includes the pinion gear 4*a* and a bevel gear 4*b*. The pinion gear 4*a* and the bevel gear 4*b* engage with each other.

The propeller shaft 5 extends in a direction orthogonal to the drive shaft 3. A back end of the propeller shaft 5 is mounted with a propeller 5*a*. The drive force of the drive shaft 3 is transmitted to the propeller shaft 5 through the gear portion 4 so as to rotate the propeller shaft 5 about a rotation axis A2.

The ECU 6 includes a CPU, a storage portion, etc. The ECU 6 controls the operation of the power source 2 on the basis of the operation of an accelerator grip 82 performed by a user.

Figure 2:
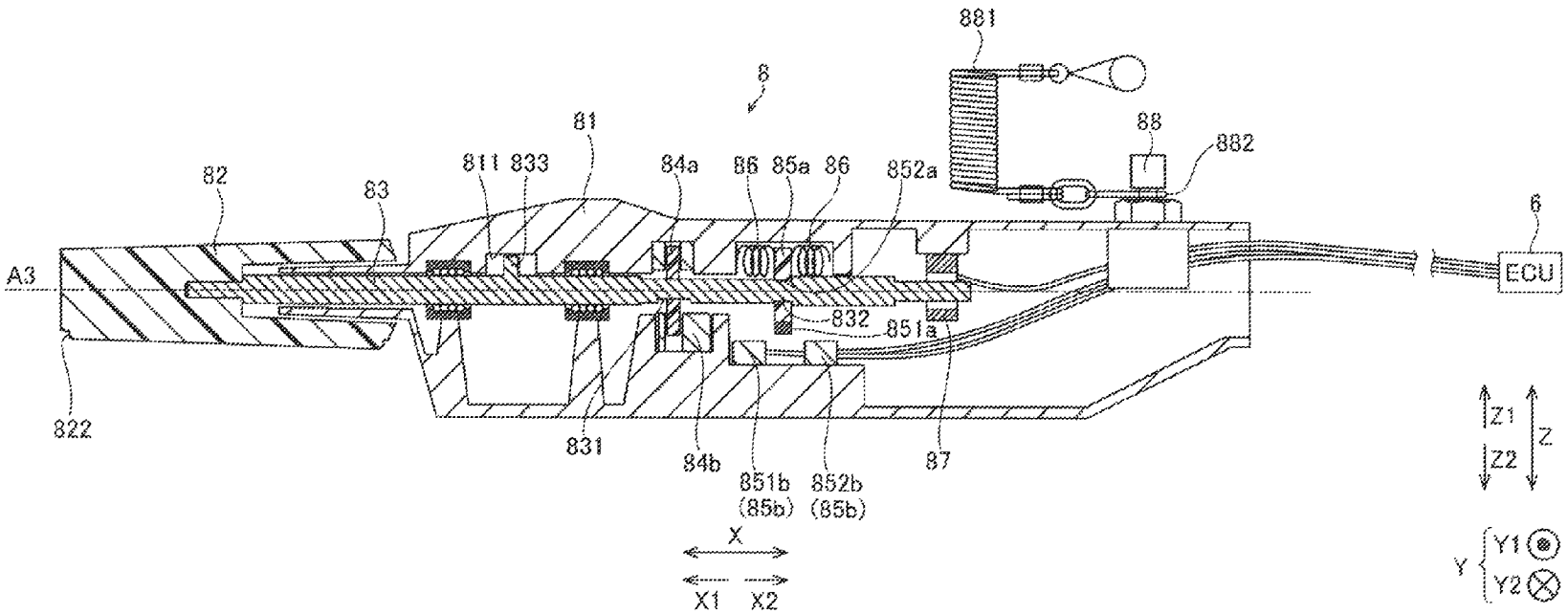
FIG. 2 is a diagram for illustrating the structure of a steering handle of the marine propulsion device according to the first embodiment of the present invention.

As shown in FIG. 2, the steering handle 8 includes a steering handle housing 81, the accelerator grip 82, a shaft member 83, and a friction plate 84*a*. The steering handle 8 also includes a neutral correction plate 85*a*, urging members 86, a rotation angle detecting sensor 87, and an emergency stop switch 88. The steering handle 8 extends forward (the extensional direction of the propeller shaft 5, see FIG. 1) with respect to the power source 2. The steering handle 8 has a function of turning the marine propulsion device 1 with respect to the boat body 50 and changing a direction in which the thrust force of the marine propulsion device 1 is applied by rotation in a right-left direction of the boat body 50 about the bracket 50*a* arranged on a back end of the boat body 50. At this time, the power source 2 is controlled by operating the accelerator grip 82 in either a forward movement rotation region 910 (see FIG. 6) or a reverse movement rotation region 920 (see FIG. 6) described later.

The steering handle housing 81 is a case member that stores the shaft member 83, the neutral correction plate 85*a*, etc. The steering handle housing 81 includes a second engaging portion 811.

Figure 3:
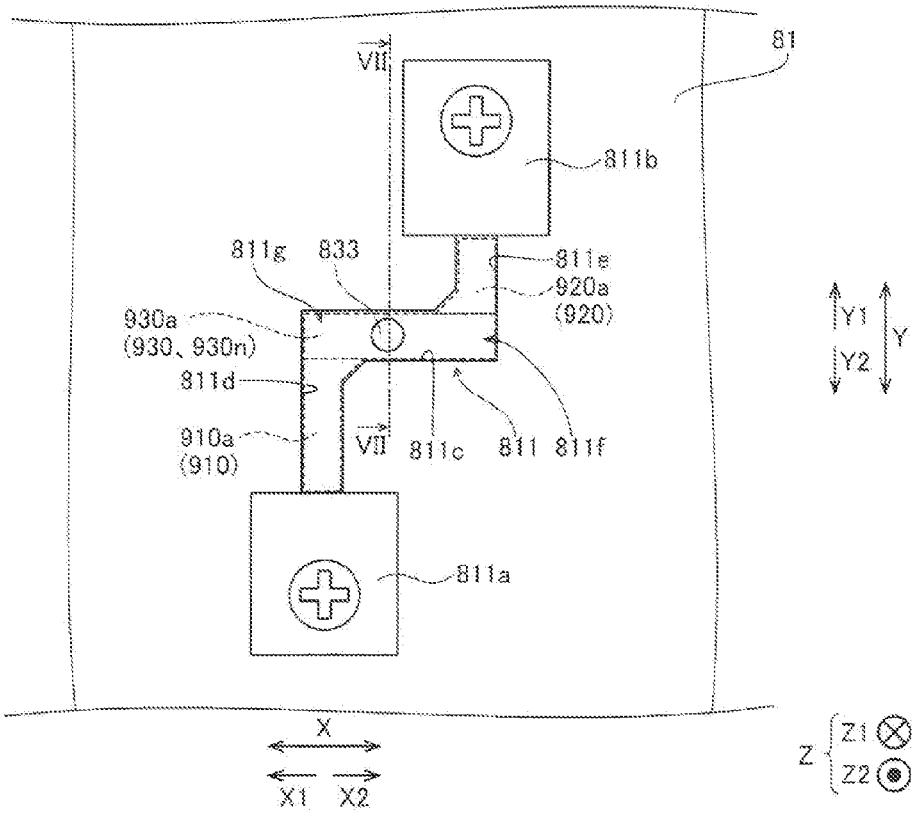
FIG. 3 is a diagram schematically showing an engaging state between a first engaging portion and a second engaging portion of the marine propulsion device according to the first embodiment of the present invention, as viewed in a direction *Z*2.
Figure 4:
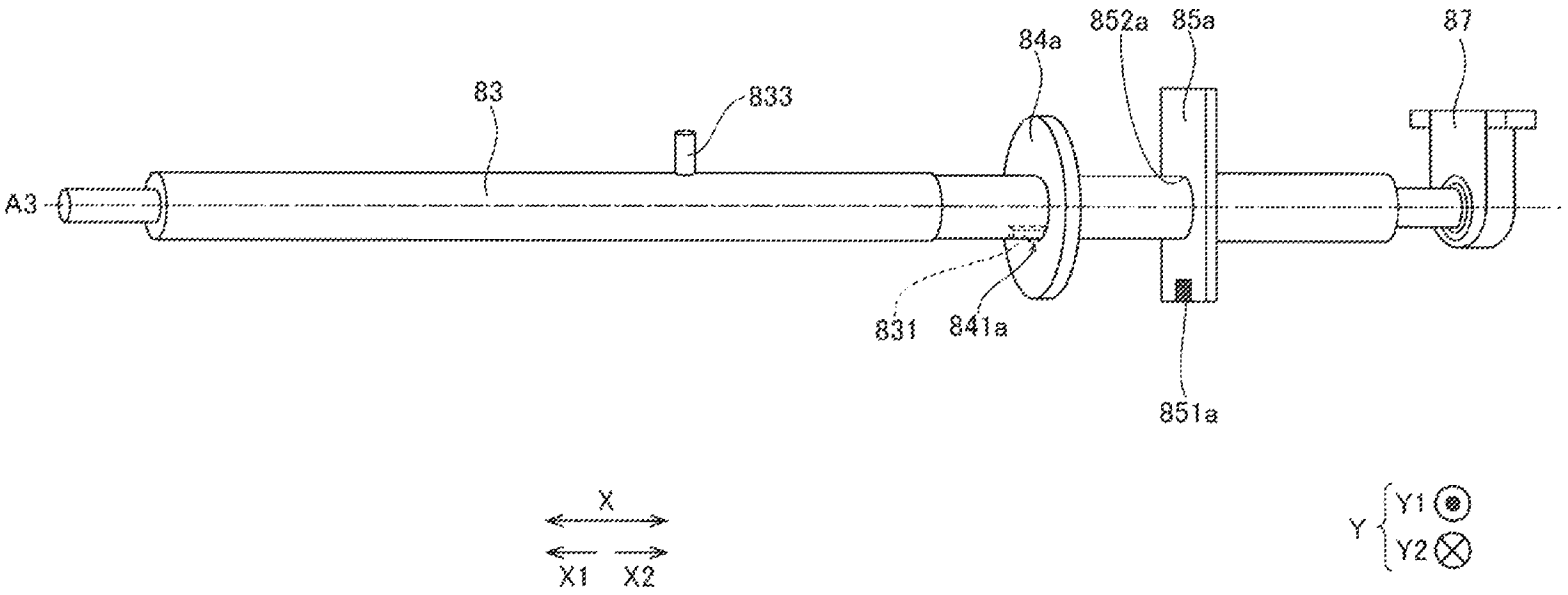
FIG. 4 is a diagram for illustrating a shaft member of the marine propulsion device according to the first embodiment of the present invention.

The second engaging portion 811 is a groove provided in an upper side portion of the inner surface of the steering handle housing 81. As shown in FIG. 3, the second engaging portion 811 has a schematic shape in which a straight line is bent. Specifically, an axis guide portion of the second engaging portion 811 that corresponds to a first engaging region 930*a* described later is longitudinal in a direction X. A forward movement rotation guide portion 811*d* Portions of the second engaging portion 811 that correspond to a second engaging region 910*a* described later and a reverse movement rotation guide portion 811*e* of the second engaging portion 811 correspond to a third engaging region 920*a* described later are longitudinal in a direction (direction Y) perpendicular to the direction X. The forward movement rotation guide portion 811*d* of the second engaging portion 811 that correspond to the second engaging region 910*a* and the reverse movement rotation guide portion 811*e* of the second engaging portion 811 that correspond to the third engaging region 920*a* extend in opposite directions. The forward movement rotation guide portion 811*d* that correspond to the second engaging region 910*a* and the reverse movement rotation guide portion 811*e* of the second engaging portion 811 that correspond to the third engaging region 920*a* are connected to the vicinities of one edge portion 811*f* and the other edge portion 811*g* of the axis guide portion 811*c* that corresponds to the first engaging region 930*a* in the direction X, respectively. The second engaging portion 811 engages with a first engaging portion 833 of the shaft member 83. The second engaging portion 811 includes a stopper 811*a* that restricts rotation of the first engaging portion 833 of the shaft member 83 in a direction Y2 in the second engaging region 910*a* described later. The second engaging portion 811 includes a stopper 811*b* that restricts rotation of the first engaging portion 833 of the shaft member 83 in a direction Y1 in the third engaging region 920*a* described later. In this description, the direction X is a concept indicating the longitudinal direction of the shaft member 83.

Figure 6:
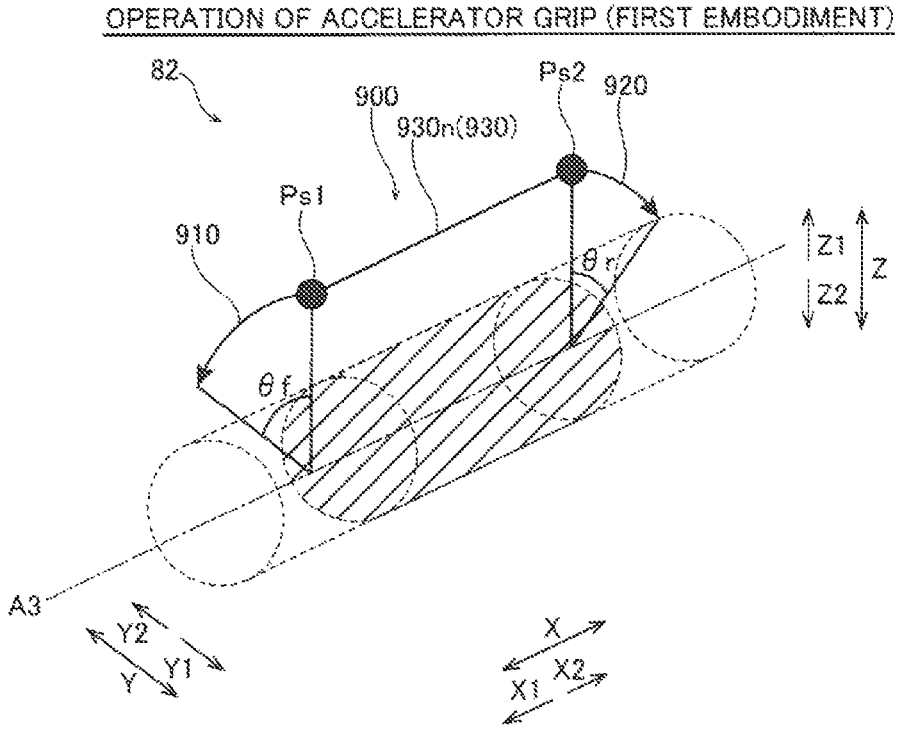
FIG. 6 is a diagram schematically showing the operation of an accelerator grip of the marine propulsion device according to the first embodiment of the present invention.
Figure 7:
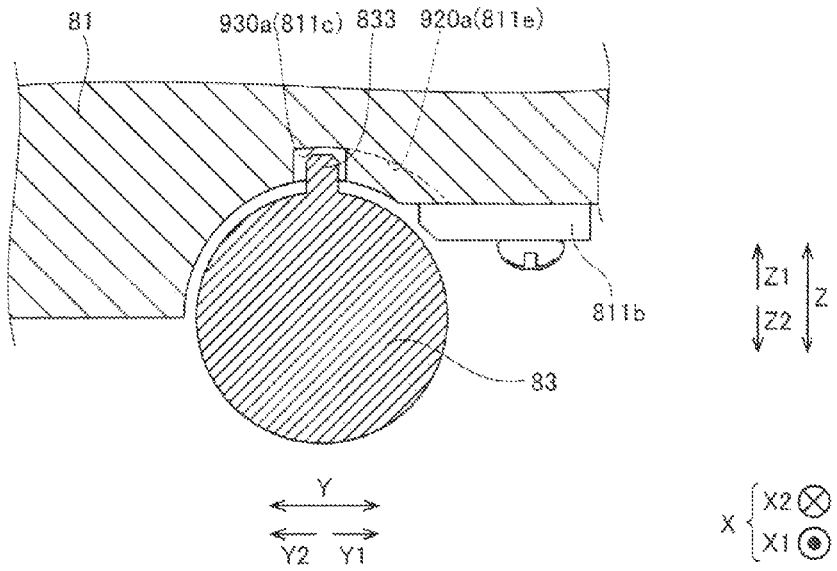
FIG. 7 is a sectional view taken along the line VII-VII in FIG. 3.

As shown in FIG. 2, the accelerator grip 82 is arranged in an end of the steering handle 8 in a direction X1. The accelerator grip 82 is movably mounted on the steering handle 8. The accelerator grip 82 moves into the forward movement rotation region 910 where the accelerator grip 82 is operated to rotate about a rotation axis A3, the reverse movement rotation region 920 where the accelerator grip 82 is operated to rotate about the rotation axis A3, and an axis movement region 930 where the accelerator grip 82 is moved in the extensional direction (direction X) of the rotation axis A3, as shown in FIG. 6. In FIG. 6, the accelerator grip 82 arranged in the axis movement region 930 is shown by diagonal lines. The accelerator grip 82 is described later in detail. In this description, the direction X1 is a concept indicating a direction away from the marine propulsion device 1, and a direction X2 is a concept indicating a direction toward the marine propulsion device 1.

As shown in FIG. 2, the shaft member 83 is fixedly connected to the accelerator grip 82 in the vicinity of an end in the direction X1. The shaft member 83 is supported by the steering handle housing 81. The shaft member 83 is schematically a shaft-shaped (see FIG. 4) member that extends in the direction X. The shaft member 83 includes a recess portion 831, a diameter reduction portion 832, and the first engaging portion 833. The first engaging portion 833 is in the form of a boss that protrudes upward.

Figure 5:
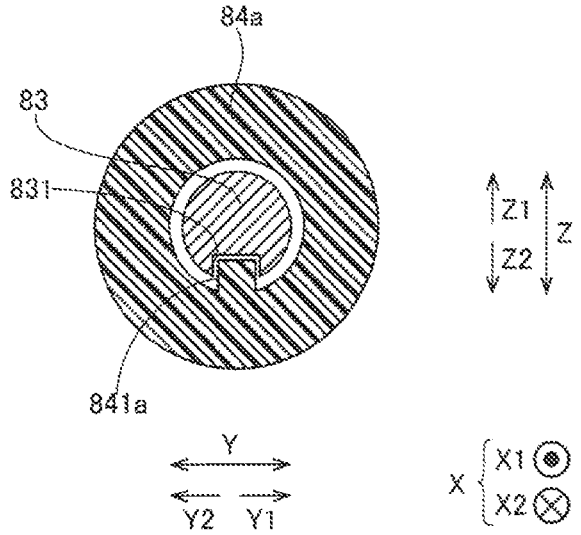
FIG. 5 is a diagram showing the shaft member and a friction plate of the marine propulsion device according to the first embodiment of the present invention.

As shown in FIG. 5, the friction plate 84*a* is a ring-shaped plate member. The friction plate 84*a* includes a projecting portion 841*a* that projects upward (in the direction Z1) from a lower portion of an inner peripheral portion. The projecting portion 841*a* does not engage with the recess portion 831 of the shaft member 83 in the extensional direction of the rotation axis A3 to not limit movement of the shaft member 83 within a certain distance along the extensional direction, but engages therewith in a rotation direction to rotate with the shaft member 83 in the rotational direction. Thus, the shaft member 83 moves in the extensional direction (direction X) of the rotation axis A3 independently of the friction plate 84*a*. The shaft member 83 rotates together with the friction plate 84*a* in the rotation direction of the shaft member 83. As shown in FIG. 2, a friction adjustment mechanism 84*b* is provided adjacent to the friction plate 84*a*. A degree of contact between the friction plate 84*a* and the friction adjustment mechanism 84*b* is adjusted such that resistance generated when the shaft member 83 rotates is adjusted.

The neutral correction plate 85*a* is a plate-like member that includes a magnet 851*a* in a lower end. The neutral correction plate 85*a* includes a hole 852*a* in a substantially central portion, as viewed in the direction X. The hole 852*a* of the neutral correction plate 85*a* engages with the diameter reduction portion 832 of the shaft member 83. The inner diameter of the hole 852*a* is smaller than those of both outside portions of the diameter reduction portion 832 of the shaft member 83. The neutral correction plate 85*a* is held by both the outside portions of the diameter reduction portion 832. Thus, the shaft member 83 moves in the extensional direction (direction X) of the rotation axis A3 together with the neutral correction plate 85*a*. The shaft member 83 moves independently of the neutral correction plate 85*a* in the rotation direction of the shaft member 83. In other words, rotation of the shaft member 83 does not cause rotation of the neutral correction plate 85*a*.

The position of the magnet 851*a* in the extensional direction (direction X) of the rotation axis A3 of the shaft member 83 is detected by magnetic sensors 85*b* (851*b*, 852*b*) provided in the steering handle housing 81. The ECU 6 acquires information detected by the magnetic sensors 85*b* and determines the position of the accelerator grip 82 in the direction X. Specifically, when the magnetic sensor 851*b* in the direction X1 detects the magnet 851*a*, the ECU 6 determines that the accelerator grip 82 is arranged in the forward movement rotation region 910. When the magnetic sensor 852*b* in the direction X2 detects the magnet 851*a*, the ECU 6 determines that the accelerator grip 82 is arranged in the reverse movement rotation region 920. When neither the magnetic sensor 851*b* nor 852*b* detects the magnet 851*a*, the ECU 6 determines that the accelerator grip 81 is arranged in the axis movement region 930.

A pair of urging members 86 are provided. The pair of urging members 86 hold an upper portion of the neutral correction plate 85*a* therebetween from both sides in the direction X. The urging members 86 urge the neutral correction plate 85*a* so as to locate the accelerator grip 82 in a neutral region 930*n* (see FIG. 6) when the accelerator grip 82 moves into the axis movement region 930.

The rotation angle detecting sensor 87 is arranged in the vicinity of an end of the shaft member 83 in the direction X2. The end of the shaft member 83 in the direction X2 is rotatably inserted into the rotation angle detecting sensor 87. The rotation angle detecting sensor 87 detects the rotation angle of the shaft member 83 when the accelerator grip 82 is rotationally operated. The ECU 6 acquires information detected by the rotation angle detecting sensor 87 and determines the rotational operation angle of the accelerator grip 82.

An emergency stop cord 881 is pulled to remove a clip 882 such that the emergency stop switch 88 brings the marine propulsion device 1 to an emergency stop.

The accelerator grip 82 is now described in detail.

As shown in FIG. 6, a movement region 900 of the accelerator grip 82 includes the forward movement rotation region 910 where the accelerator grip 82 is operated to rotate about the rotation axis A3 so as to obtain drive force in the forward movement direction from the power source 2 (see FIG. 2). The movement region 900 of the accelerator grip 82 also includes the reverse movement rotation region 920 where the accelerator grip 82 is operated to rotate about the rotation axis A3 so as to obtain drive force in the reverse movement direction from the power source 2. The accelerator grip 82 rotates to draw a track along an arc centered on the rotation axis A3 in each of the forward movement rotation region 910 and the reverse movement rotation region 920. Specifically, the rotation starting point Ps1 of the accelerator grip 82 moves to draw a track along the arc centered on the rotation axis A3 in the direction Y2 in the forward movement rotation region 910. The rotation starting point Ps1 is a position in the forward movement rotation region 910 that is neutral such that minimal or no drive force is generated. The rotation starting point Ps2 of the accelerator grip 82 moves to draw a track along the arc centered on the rotation axis A3 in the direction Y1 in the reverse movement rotation region 920. The rotation starting point Ps2 is a position in the reverse movement rotation region 930 that is neutral such that minimal or no drive force is generated. In this description, the forward movement rotation region 910 is a concept indicating a region where the rotation starting point Ps1 of the accelerator grip 82 moves in the direction Y2 about the rotation axis A3. The reverse movement rotation region 920 is a concept indicating a region where the rotation starting point Ps2 of the accelerator grip 82 moves in the direction Y1 about the rotation axis A3.

The movement region 900 of the accelerator grip 82 includes the axis movement region 930 provided between the forward movement rotation region 910 and the reverse movement rotation region 920, where the accelerator grip 82 is moved in the extensional direction (direction X) of the rotation axis A3. The axis movement region 930 is the neutral region 930*n* where no drive force in the forward movement direction or in the reverse movement direction is generated. The forward movement rotation region 910 and the reverse movement rotation region 920 are separated from each other by the axis movement region 930. The rotation direction of the accelerator grip 82 is changed such that the normal rotation and the reverse rotation of the electric motor (see FIG. 1) that the power source 2 includes are switched. In this description, the axis movement region 930 is a concept indicating a region between the rotation starting point Ps1 of the accelerator grip 82 and the rotation starting point Ps2 of the accelerator grip 82.

The forward movement rotation region 910 and the reverse movement rotation region 920 are arranged at positions different from each other in the extensional direction of the rotation axis A3. Specifically, the forward movement rotation region 910 is connected to the vicinity of an end of the axis movement region 930 in the direction X1, and the reverse movement rotation region 920 is connected to the vicinity of an end of the axis movement region 930 in the direction X2. The forward movement rotation region 910 and the reverse movement rotation region 920 are arranged to hold the axis movement region 930 therebetween. The forward movement rotation region 910 and the reverse movement rotation region 920 are arranged not to overlap each other, as viewed in the extensional direction of the rotation axis A3. The rotation direction of the accelerator grip 82 is opposite in the forward movement rotation region 910 and the reverse movement rotation region 920. That is, as illustrated in FIG. 6, in the forward movement rotation region 910, a rotation direction away from the rotation starting point Ps1 of the accelerator grip 82 is in a first direction. In the reverse movement rotation region 920, a rotation direction away from the rotation starting point Ps2 of the accelerator grip 82 is in a second direction opposite the first direction.

As shown in FIG. 3, the forward movement rotation region 910 corresponds to the second engaging region 910*a* where the first engaging portion 833 of the shaft member 83 (see FIG. 4) and the second engaging portion 811 of the steering handle housing 81 engage with each other. The reverse movement rotation region 920 corresponds to the third engaging region 920*a* where the first engaging portion 833 and the second engaging portion 811 engage with each other. The axis movement region 930 corresponds to the first engaging region 930*a* where the first engaging portion 833 and the second engaging portion 811 engage with each other.

The shaft member 83 (see FIG. 4) moves in the extensional direction (direction X, see FIGS. 6 and 7) of the rotation axis A3 with respect to the steering handle housing 81 in the first engaging region 930*a* (the axis guide portion 811*c*) that corresponds to the axis movement region 930 (see FIG. 6) in a state where the first engaging portion 833 of the shaft member 83 and the second engaging portion 811 of the steering handle housing 81 engage with each other (hereinafter referred to as the engaging state). The shaft member 83 rotates (see FIG. 6) about the rotation axis A3 with respect to the steering handle housing 81 in the second engaging region 910*a* (the forward movement rotation guide portion 811*d*) that corresponds to the forward movement rotation region 910 (see FIG. 6) in the engaging state. The shaft member 83 rotates (see FIG. 6) about the rotation axis A3 with respect to the steering handle housing 81 in the third engaging region 920*a* (the reverse movement rotation guide portion 811*e*) that corresponds to the reverse movement rotation region 920 (see FIG. 6) in the engaging state. Thus, the shaft member 83 moves or rotates with respect to the steering handle housing 81 while the first engaging portion 833 of the shaft member 83 is guided by the second engaging portion 811 of the steering handle housing 81.

As shown in FIG. 6, the accelerator grip 82 is switched from a rotationally operable state in the forward movement rotation region 910 to a rotationally operable state in the reverse movement rotation region 920 through the axis movement region 930 in the extensional direction of the rotation axis A3, and is switched from the rotationally operable state in the reverse movement rotation region 920 to the rotationally operable state in the forward movement rotation region 910 through the axis movement region 930 in the extensional direction of the rotation axis A3.

The accelerator grip 82 rotates in the direction Y2 by a maximum rotational operation angle θf at which a maximum output is generated during forward movement in the forward movement rotation region 910. At this time, the ECU 6 determines that the accelerator grip 82 is arranged in the forward movement rotation region 910 on the basis of information about the magnet 851*a* of the neutral correction plate 85*a* detected by the magnetic sensor 851*b*. Then, the first engaging portion 833 of the shaft member 83 comes into contact with the stopper 811*a* (see FIG. 3) in the second engaging region 910*a*, and the rotation angle detecting sensor 87 (see FIG. 2) detects the rotation angle (maximum rotational operation angle θf) of the shaft member 83. Thus, the ECU 6 controls the power source 2 to generate maximum thrust force in the forward movement direction. The accelerator grip 82 rotates in the direction Y1 by a maximum rotational operation angle θr at which a maximum output is generated during reverse movement in the reverse movement rotation region 920. At this time, the ECU 6 determines that the accelerator grip 82 is arranged in the reverse movement rotation region 920 on the basis of information about the magnet 851*a* of the neutral correction plate 85*a* detected by the magnetic sensor 852*b*. Then, the first engaging portion 833 of the shaft member 83 comes into contact with the stopper 811*b* (see FIG. 3) in the third engaging region 920*a*, and the rotation angle detecting sensor 87 detects the rotation angle (maximum rotational operation angle θr) of the shaft member 83. Thus, the ECU 6 controls the power source 2 to generate maximum thrust force in the reverse movement direction.

The maximum rotational operation angle θf of the accelerator grip 82 in the forward movement rotation region 910 is larger than the maximum rotational operation angle θr of the accelerator grip 82 in the reverse movement rotation region 920. In other words, the accelerator grip 82 has the maximum amount of rotation different in the direction Y2 and the direction Y1. At the maximum rotational operation angles θf and θr of the accelerator grip 82, the rotation directions of the power source 2 are opposite to each other, but the generated outputs are the same.

Figure 8:
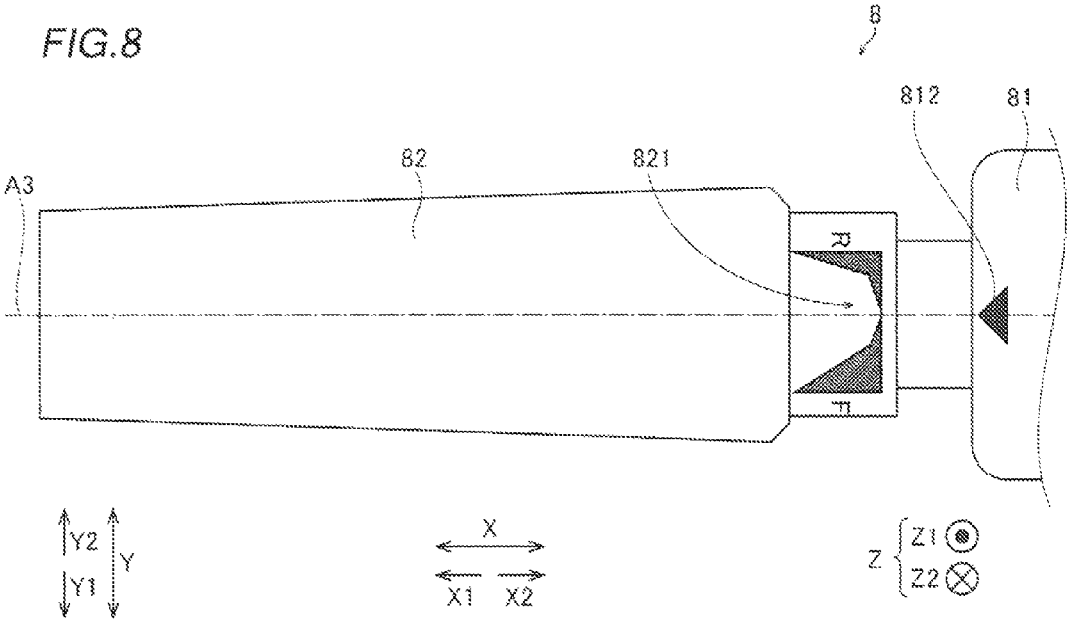
FIG. 8 is a plan view showing the accelerator grip of the marine propulsion device according to the first embodiment of the present invention.

As shown in FIG. 8, the accelerator grip 82 is provided with a mark portion 821 that indicates the output of the power source 2 associated with the rotation region (rotation direction) and the rotation angle of the accelerator grip 82. In the mark portion 821, the forward movement rotation region 910 (see FIG. 6) is indicated by "F", and the reverse movement rotation region 920 (see FIG. 6) is indicated by "R". The steering handle housing 81 is provided with an arrow portion 812 that indicates an accelerator position in the mark portion 821 of the accelerator grip 82. Thus, when the accelerator grip 82 rotates to either the forward movement rotation region 910 or the reverse movement rotation region 920, the user easily recognizes that the output in the rotation region (rotation direction) indicated by the arrow portion 812 is generated from the power source 2. The mark portion 821 and the arrow portion 812 may be printed on the accelerator grip 82 and the steering handle housing 81, respectively, or may be seal-shaped members.

As shown in FIG. 9, the accelerator grip 82 is provided with a protrusion 822. The protrusion 822 protrudes downward (in a direction Z2) in a state where the accelerator grip 82 is arranged in the neutral region 930*n* (see FIG. 6). The protrusion 822 is arranged to extend in the extensional direction (direction X) of the rotation axis A3. Thus, the user easily tactually recognizes that the accelerator grip 82 is arranged in the neutral region 930*n*.

According to the first embodiment, the following effects are obtained.

According to the first embodiment, as hereinabove described, the movement region 900 of the accelerator grip 82 includes the axis movement region 930 where the accelerator grip 82 is moved in the extensional direction of the rotation axis A3 between the forward movement rotation region 910 and the reverse movement rotation region 920. Thus, the accelerator grip 82 is switched from the rotationally operable state in one of the forward movement rotation region 910 and the reverse movement rotation region 920 to the rotationally operable state in the other of the forward movement rotation region 910 and the reverse movement rotation region 920 through the axis movement region 930, unlike the structure in which it is necessary to release the engaging state when the accelerator grip 82 is switched from the rotationally operable state in one of the forward movement rotation region 910 and the reverse movement rotation region 920 to the rotationally operable state in the other of the forward movement rotation region 910 and the reverse movement rotation region 920. In this case, complication of an operation of switching the rotation region of the accelerator grip 82 is significantly reduced or prevented, and the user smoothly performs the operation of switching the rotation region of the accelerator grip 82 while recognizing that the rotation region of the accelerator grip 82 is switched. Consequently, the operability is improved when the user switches the rotation region of the accelerator grip 82. Furthermore, the marine propulsion device 1 is configured as hereinabove described, whereby when the accelerator grip 82 is switched from the rotationally operable state in one of the forward movement rotation region 910 and the reverse movement rotation region 920 to the rotationally operable state in the other of the forward movement rotation region 910 and the reverse movement rotation region 920, restriction of the posture of the user (restriction of a gripped position of the accelerator grip 82) is significantly reduced when the user operates the accelerator grip 82, unlike the structure in which it is necessary for the user to grip a position of the accelerator grip 82 where the engaging state is released.

According to the first embodiment, the forward movement rotation region 910 and the reverse movement rotation region 920 are arranged at the positions different from each other in the extensional direction of the rotation axis A3. Thus, the forward movement rotation region 910 and the reverse movement rotation region 920 are arranged separately in the extensional direction of the rotation axis A3, and hence the user easily recognizes the forward movement rotation region 910 and the reverse movement rotation region 920 on the basis of a difference in the position in the extensional direction of the rotation axis A3.

According to the first embodiment, the forward movement rotation region 910 and the reverse movement rotation region 920 are arranged not to overlap each other, as viewed in the extensional direction of the rotation axis A3. The rotation direction of the accelerator grip 82 is set to be opposite in the forward movement rotation region 910 and the reverse movement rotation region 920. Thus, the user more easily recognizes the forward movement rotation region 910 and the reverse movement rotation region 920, unlike the case where the rotation direction of the accelerator grip 82 is the same in the forward movement rotation region 910 and the reverse movement rotation region 920. Furthermore, the user more easily recognizes the forward movement rotation region 910 and the reverse movement rotation region 920 on the basis of a difference in the position about the rotation axis A3.

According to the first embodiment, the neutral region 930*n* where no drive force in the forward movement direction or in the reverse movement direction is generated is provided in the axis movement region 930. Thus, unless the accelerator grip 82 passes through the neutral region 930*n*, the accelerator grip 82 does not rotate from one of the forward movement rotation region 910 and the reverse movement rotation region 920 into the other of the forward movement rotation region 910 and the reverse movement rotation region 920. Consequently, complication of the operation of switching the rotation region of the accelerator grip 82 is significantly reduced or prevented, and the user smoothly performs the operation of switching the rotation region of the accelerator grip 82 while recognizing that a state of forward movement drive or reverse movement drive switches to a state of opposite drive. Furthermore, the extra load on the power source is significantly reduced or prevented when the state of forward movement drive or reverse movement drive switches to the state of opposite drive.

According to the first embodiment, the forward movement rotation region 910 and the reverse movement rotation region 920 are separated from each other by the axis movement region 930. Thus, even when the forward movement rotation region 910 and the reverse movement rotation region 920 are not arranged separately in the extensional direction of the rotation axis A3, the user more easily recognizes the forward movement rotation region 910 and the reverse movement rotation region 920 by the separation of the forward movement rotation region 910 from the reverse movement rotation region 920 by the axis movement region 930.

According to the first embodiment, the maximum rotational operation angle θf of the accelerator grip 82 in the forward movement rotation region 910 is larger than the maximum rotational operation angle θr of the accelerator grip 82 in the reverse movement rotation region 920. Thus, the user easily recognizes whether the accelerator grip 82 has rotated into the forward movement rotation region 910 or the reverse movement rotation region 920 and easily finely adjusts an output for forward movement.

According to the first embodiment, the urging members 86 are provided to urge the accelerator grip 82 so as to locate the accelerator grip 82 in the neutral region 930*n*. Thus, the accelerator grip 82 is located in the neutral region 930*n* even when the user releases his/her hand from the accelerator grip 82 in the case where the power source generates no output in the forward movement rotation region 910 and the reverse movement rotation region 920.

According to the first embodiment, the power source 2 including the electric motor is provided. Thus, in the marine propulsion device 1 in which the power source 2 includes the electric motor, complication of the operation of switching the rotation region of the accelerator grip 82 is significantly reduced or prevented, and the user smoothly performs the operation of switching the rotation region of the accelerator grip 82 while recognizing that the rotation region of the accelerator grip 82 is switched.

According to the first embodiment, the shaft member 83 moves in the extensional direction of the rotation axis A3 with respect to the steering handle housing 81 in the first engaging region 930*a* that corresponds to the axis movement region 930 in the state where the first engaging portion 833 of the shaft member 83 and the second engaging portion 811 of the steering handle housing 81 engage with each other. Furthermore, the shaft member 83 rotates about the rotation axis A3 with respect to the steering handle housing 81 in the second engaging region 910*a* that corresponds to the forward movement rotation region 910 and the third engaging region 920*a* that corresponds to the reverse movement rotation region 920. Thus, the accelerator grip 82 rotates and axially moves in the state where the first engaging portion 833 of the shaft member 83 and the second engaging portion 811 of the steering handle housing 81 engage with each other, and hence the first engaging portion 833 of the shaft member 83 is guided by the second engaging portion 811 of the steering handle housing 81 and is moved to a prescribed position. Consequently, the accelerator grip 82 is accurately operated.

Second Embodiment

The structure of a marine propulsion device 200 according to a second embodiment of the present invention is now described with reference to FIGS. 10 and 11.

In the second embodiment, the marine propulsion device 200 in which a forward movement rotation region 910 and a reverse movement rotation region 920 overlap each other, as viewed in the extensional direction of a rotation axis A3 is described, unlike the first embodiment in which the forward movement rotation region 910 and the reverse movement rotation region 920 do not overlap each other, as viewed in the extensional direction of the rotation axis A3. Portions of the marine propulsion device 200 similar to those of the marine propulsion device 1 according to the aforementioned first embodiment are denoted by the same reference numerals, to omit the description.

As shown in FIG. 10, in the marine propulsion device 200 according to the second embodiment, a second engaging portion 891*a* is substantially U-shaped. Specifically, a forward movement rotation guide portion 891*d* of the second engaging portion 891*a* that correspond to a second engaging region 910*a* and a reverse movement rotation guide portion 891*e* of the second engaging portion 891*a* that correspond to a third engaging region 920*a* extend in the same direction. The second engaging portion 891*a* includes a stopper 811*a* that restricts rotation of a first engaging portion 833 of a shaft member 83 in a direction Y2 in the second engaging region 910*a*. The second engaging portion 891*a* includes a stopper 811*b* that restricts rotation of the first engaging portion 833 of the shaft member 83 in the direction Y2 in the third engaging region 920*a*.

As shown in FIG. 11, the forward movement rotation region 910 and the reverse movement rotation region 920 are arranged at positions different from each other in the extensional direction of the rotation axis A3. The forward movement rotation region 910 and the reverse movement rotation region 920 are arranged to overlap each other, as viewed in the extensional direction of the rotation axis A3. The rotation direction of an accelerator grip 82 is the same (direction Y2) in the forward movement rotation region 910 and the reverse movement rotation region 920.

More specifically, the shaft member 83 (see FIG. 4) moves in the extensional direction (direction X, see FIG. 10) of the rotation axis A3 with respect to a steering handle housing 81 in a first engaging region 930*a* (an axis guide portion 891*f*) that corresponds to an axis movement region 930 in an engaging state where the first engaging portion 833 of the shaft member 83 and the second engaging portion 891*a* of the steering handle housing 81 engage with each other, as shown in FIG. 10. The shaft member 83 rotates (see FIG. 10) about the rotation axis A3 with respect to the steering handle housing 81 in the second engaging region 910*a* (the forward movement rotation guide portion 891*d*) that corresponds to the forward movement rotation region 910 in the engaging state. Furthermore, the shaft member 83 rotates (see FIG. 10) about the rotation axis A3 with respect to the steering handle housing 81 in the third engaging region 920*a* (the reverse movement rotation guide portion 891*e*) that corresponds to the reverse movement rotation region 920 in the engaging state. Thus, the shaft member 83 moves with respect to the steering handle housing 81 while the first engaging portion 833 of the shaft member 83 is guided by the second engaging portion 891*a* of the steering handle housing 81.

According to the second embodiment, the following effects are obtained.

According to the second embodiment, the marine propulsion device 200 is configured as hereinabove described, whereby complication of an operation of switching the rotation region of the accelerator grip 82 is significantly reduced or prevented, and a user smoothly performs the operation of switching the rotation region of the accelerator grip 82 while recognizing that the rotation region of the accelerator grip 82 is switched, similarly to the first embodiment. Furthermore, restriction of the posture of the user is significantly reduced when the user operates the accelerator grip 82.

According to the second embodiment, the forward movement rotation region 910 and the reverse movement rotation region 920 are arranged to overlap each other, as viewed in the extensional direction of the rotation axis A3. The rotation direction of the accelerator grip 82 is set to be the same in the forward movement rotation region 910 and the reverse movement rotation region 920. Thus, a space (rotation angle range) where the forward movement rotation region 910 and the reverse movement rotation region 920 are arranged is reduced in size, as viewed in the extensional direction of the rotation axis A3, unlike the case where the rotation direction of the accelerator grip 82 is opposite in the forward movement rotation region 910 and the reverse movement rotation region 920.

The remaining effects of the second embodiment are similar to those of the aforementioned first embodiment.

Third Embodiment

The structure of a marine propulsion device 300 according to a third embodiment of the present invention is now described with reference to FIGS. 12 and 13.

In the third embodiment, the marine propulsion device 300 in which a forward movement rotation region 910 and a reverse movement rotation region 920 are provided at the same positions in the extensional direction of a rotation axis A3 is described, unlike the first embodiment in which the forward movement rotation region 910 and the reverse movement rotation region 920 are provided at the positions different from each other in the extensional direction of the rotation axis A3. Portions of the marine propulsion device 300 similar to those of the marine propulsion device 1 according to the aforementioned first embodiment are denoted by the same reference numerals, to omit the description.

As shown in FIG. 12, in the marine propulsion device 300 according to the third embodiment, an axis guide portion 891*g* of a second engaging portion 891*b* that corresponds to a first engaging region 930*a* is substantially U-shaped. A forward movement rotation guide portion 891*h* of the second engaging portion 891*b* that correspond to a second engaging region 910*a* and a reverse movement rotation guide portion 891*i* of the second engaging portion 891*b* that correspond to a third engaging region 920*a* are longitudinal in a direction (direction Y) perpendicular to a direction X. The forward movement rotation guide portion 891*h* of the second engaging portion 891*b* that correspond to the second engaging region 910*a* and the reverse movement rotation guide portion 891*i* of the second engaging portion 891*b* that correspond to the third engaging region 920*a* extend in opposite directions. The forward movement rotation guide portion 891*h* that correspond to the second engaging region 910*a* and the reverse movement rotation guide portion 891*i* of the second engaging portion 891*b* that correspond to the third engaging region 920*a* are connected to the vicinities of two (different) ends (one edge portion 891*j* and the other edge portion 891*k*) of the axis guide portion 891*g* that corresponds to the first engaging region 930*a* in a direction X1.

As shown in FIG. 13, a movement region 900 of an accelerator grip 82 includes an axis movement region 930 provided between the forward movement rotation region 910 and the reverse movement rotation region 920, where the accelerator grip 82 is moved in the extensional direction (direction X) of the rotation axis A3. According to the third embodiment, the axis movement region 930 is substantially U-shaped in a plan view. The axis movement region 930 is a neutral region 930*n* where no drive force in a forward movement direction or in a reverse movement direction is generated. The axis movement region 930 includes a neutral rotation region 930*i* where the accelerator grip 82 rotates about the rotation axis A3. The neutral rotation region 930*i* is a region of the axis movement region 930 (neutral region 930*n*) that corresponds to a position offset in a direction X2 along the rotation axis A3 with respect to the forward movement rotation region 910 and the reverse movement rotation region 920. More specifically, the neutral rotation region 930*i* is located in an end of the axis movement region 930 in the direction X2.

The forward movement rotation region 910 and the reverse movement rotation region 920 are arranged at the same positions in the extensional direction of the rotation axis A3. The forward movement rotation region 910 and the reverse movement rotation region 920 are arranged not to overlap each other, as viewed in the extensional direction of the rotation axis A3. The rotation direction of the accelerator grip 82 is opposite in the forward movement rotation region 910 and the reverse movement rotation region 920.

The accelerator grip 82 is switched from a rotationally operable state in the forward movement rotation region 910 to a rotationally operable state in the reverse movement rotation region 920 through the axis movement region 930, and is switched from the rotationally operable state in the reverse movement rotation region 920 to the rotationally operable state in the forward movement rotation region 910 through the axis movement region 930. Specifically, the accelerator grip 82 is switched from the rotationally operable state in the forward movement rotation region 910 to the rotationally operable state in the reverse movement rotation region 920 through the neutral rotation region 930*i*, and is switched from the rotationally operable state in the reverse movement rotation region 920 to the rotationally operable state in the forward movement rotation region 910 through the neutral rotation region 930*i*. Thus, a user operates the accelerator grip 82 while sequentially confirming the movement region where the accelerator grip 82 is arranged.

According to the third embodiment, the following effects are obtained.

According to the third embodiment, the marine propulsion device 300 is configured as hereinabove described, whereby complication of an operation of switching the rotation region of the accelerator grip 82 is significantly reduced or prevented, and the user smoothly performs the operation of switching the rotation region of the accelerator grip 82 while recognizing that the rotation region of the accelerator grip 82 is switched, similarly to the first embodiment. Furthermore, restriction of the posture of the user is significantly reduced when the user operates the accelerator grip 82.

According to the third embodiment, the forward movement rotation region 910 and the reverse movement rotation region 920 are provided at substantially the same positions in the extensional direction of the rotation axis A3. The rotation direction of the accelerator grip 82 is set to be opposite in the forward movement rotation region 910 and the reverse movement rotation region 920. Furthermore, the accelerator grip 82 is switched from the rotationally operable state in the forward movement rotation region 910 to the rotationally operable state in the reverse movement rotation region 920 through the axis movement region 930. Thus, even when the forward movement rotation region 910 and the reverse movement rotation region 920 are not arranged separately in the extensional direction of the rotation axis A3, the user easily recognizes the forward movement rotation region 910 and the reverse movement rotation region 920 by setting the rotation direction of the accelerator grip 82 to be opposite in the forward movement rotation region 910 and the reverse movement rotation region 920. Furthermore, unlike the case where the forward movement rotation region 910 and the reverse movement rotation region 920 of the accelerator grip 82 are arranged separately in the extensional direction of the rotation axis A3, a space (the length in the extensional direction of the rotation axis A3) where the forward movement rotation region 910 and the reverse movement rotation region 920 are arranged is reduced in size in the plan view.

According to the third embodiment, the accelerator grip 82 is switched from the rotationally operable state in the forward movement rotation region 910 to the rotationally operable state in the reverse movement rotation region 920 through the neutral rotation region 930*i* offset in the extensional direction of the rotation axis A3 with respect to the forward movement rotation region 910 and the reverse movement rotation region 920. Thus, complication of the operation of switching the rotation region of the accelerator grip 82 is significantly reduced or prevented, and the user smoothly performs the operation of switching the rotation region of the accelerator grip 82 while recognizing that the accelerator grip 82 is switched from the rotationally operable state in the forward movement rotation region 910 to the rotationally operable state in the reverse movement rotation region 920 through the neutral rotation region 930*i*.

The remaining effects of the third embodiment are similar to those of the aforementioned first embodiment.

Fourth Embodiment

The structure of a marine propulsion device 400 according to a fourth embodiment of the present invention is now described with reference to FIGS. 14 to 16.

In the fourth embodiment, the marine propulsion device 400 in which an accelerator grip 82 goes through an axis movement region 930 or a detour region 940 when switched from a rotationally operable state in a reverse movement rotation region 920 to a rotationally operable state in a forward movement rotation region 910 is described, unlike the first embodiment in which the accelerator grip 82 goes through the axis movement region 930 when switched from the rotationally operable state in the reverse movement rotation region 920 to the rotationally operable state in the forward movement rotation region 910. Portions of the marine propulsion device 400 similar to those of the marine propulsion device 1 according to the aforementioned first embodiment are denoted by the same reference numerals, to omit the description.

As shown in FIGS. 14 and 15, in a steering handle housing 81, a portion of a second engaging portion 891*c* that corresponds to a fourth engaging region 940*a* described later is connected to an end of a third engaging region 920*a* in a direction Y1 and an end of a second engaging region 910*a* in the direction Y1. The fourth engaging region 940*a* extends so as to be inclined at about 45 degrees counterclockwise with respect to a direction X, as viewed in a direction Z2. A portion of the second engaging portion 891*c* that corresponds to the fourth engaging region 940*a* described later is provided with a ratchet mechanism 820 that allows a first engaging portion 833 to move only in a direction Y2 but does not allow the same to move in the direction Y1. The first engaging portion 833 of a shaft member 83 engages with the second engaging portion 891*c* of the steering handle housing 81 in a first engaging region 930*a* (an axis guide portion 891*l*), the second engaging region 910*a* (a forward movement rotation guide portion 891*m*), the third engaging region 920*a* (a reverse movement rotation guide portion 891*n*), and the fourth engaging region 940*a*.

As shown in FIG. 16, a movement region 900 of the accelerator grip 82 includes the detour region 940 in addition to the forward movement rotation region 910, the reverse movement rotation region 920, and the axis movement region 930. The detour region 940 corresponds to the fourth engaging region 940*a* (see FIG. 14) where the first engaging portion 833 of the shaft member 83 (see FIG. 4) and the second engaging portion 891*c* of the steering handle housing 81 engage with each other. The axis movement region 930 and the detour region 940 are neutral regions 930*n*.

The detour region 940 is a region where the accelerator grip 82 moves from a position Ps3 rotated by a maximum rotational operation angle θf in the reverse movement rotation region 920 to a rotation starting point Ps1 in the forward movement rotation region 910. The accelerator grip 82 is switched from the rotationally operable state in the reverse movement rotation region 920 to the rotationally operable state in the forward movement rotation region 910 through either the axis movement region 930 or the detour region 940.

According to the fourth embodiment, the ratchet mechanism 820 is provided such that the accelerator grip 82 does not move from the rotation staring point Ps1 (see FIG. 16) in the forward movement rotation region 910 to the reverse movement rotation region 920 (the position Ps3, see FIG. 16) through the detour region 940, as shown in FIG. 15. Thus, the accelerator grip 82 is not switched from the rotationally operable state in the forward movement rotation region 910 to the rotationally operable state in the reverse movement rotation region 920 unless the accelerator grip 82 goes through the axis movement region 930.

According to the fourth embodiment, the following effects are obtained.

According to the fourth embodiment, the marine propulsion device 400 is configured as hereinabove described, whereby complication of an operation of switching the rotation region of the accelerator grip 82 is significantly reduced or prevented, and a user smoothly performs the operation of switching the rotation region of the accelerator grip 82 while recognizing that the rotation region of the accelerator grip 82 is switched, similarly to the first embodiment. Furthermore, restriction of the posture of the user is significantly reduced when the user operates the accelerator grip 82.

According to the fourth embodiment, the accelerator grip 82 is switched from the rotationally operable state in the forward movement rotation region 910 to the rotationally operable state in the reverse movement rotation region 920 through the axis movement region 930, and is switched from the rotationally operable state in the reverse movement rotation region 920 to the rotationally operable state in the forward movement rotation region 910 not through the axis movement region 930 but through the detour region 940. Thus, complication of the operation of switching the rotation region of the accelerator grip 82 from the forward movement rotation region 910 to the reverse movement rotation region 920 is significantly reduced or prevented, and the user smoothly performs the operation of switching the rotation region of the accelerator grip 82. Furthermore, the accelerator grip 82 is easily switched from the rotationally operable state in the reverse movement rotation region 920 to the rotationally operable state in the forward movement rotation region 910 without a complicated operation.

The remaining effects of the fourth embodiment are similar to those of the aforementioned first embodiment.

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the power source according to the present invention is the electric motor in each of the aforementioned first to fourth embodiments, the present invention is not restricted to this. According to the present invention, the power source may alternatively be an engine.

While both the forward movement rotation region 910 and the reverse movement rotation region 920 are connected to the vicinities of the ends of the axis movement region 930 in the direction X in each of the aforementioned first to fourth embodiments, the present invention is not restricted to this. According to the present invention, so far as the axis movement region is provided between the forward movement rotation region and the reverse movement rotation region, both the forward movement rotation region and the reverse movement rotation region may not be connected to the vicinities of the ends of the axis movement region in the direction X, or only one of the forward movement rotation region and the reverse movement rotation region may be connected to the vicinity of the end of the axis movement region in the direction X.

While the maximum rotational operation angle θf of the accelerator grip 82 in the forward movement rotation region 910 is larger than the maximum rotational operation angle θr of the accelerator grip 82 in the reverse movement rotation region 920 in each of the aforementioned first to fourth embodiments, the present invention is not restricted to this. According to the present invention, the maximum rotational operation angle of the accelerator grip in the forward movement rotation region may alternatively be equal to the maximum rotational operation angle of the accelerator grip in the reverse movement rotation region (the maximum amount of rotation in the direction Y2 may alternatively be equal to the maximum amount of rotation in the direction Y1).

Figure 17:
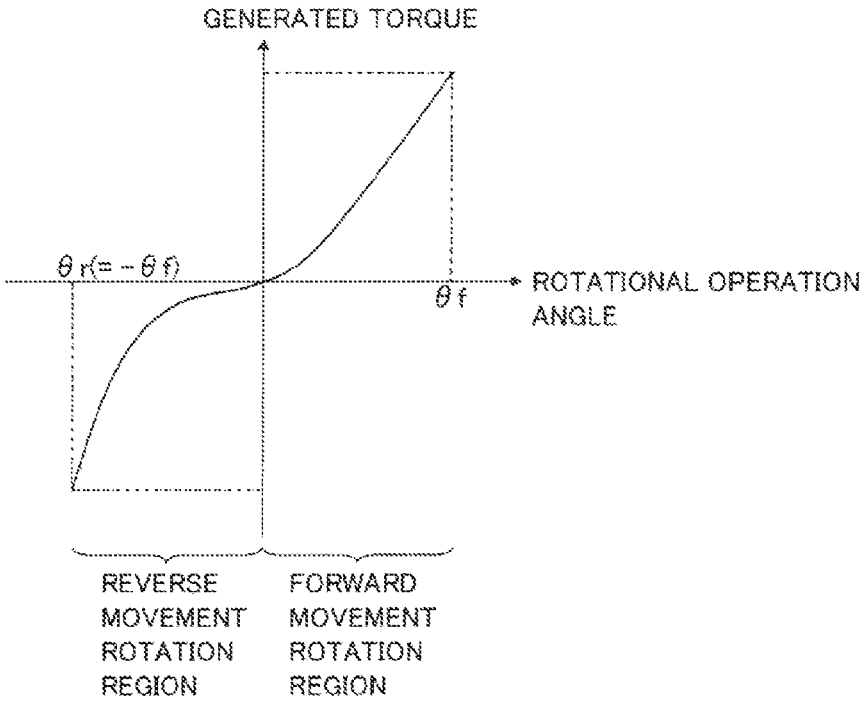
FIG. 17 is a diagram showing the relationship between the rotational operation angle of an accelerator grip and torque generated from a power source in a marine propulsion device according to a modification of the first embodiment of the present invention.

In the case where the maximum rotational operation angle of the accelerator grip in the forward movement rotation region is equal to the maximum rotational operation angle of the accelerator grip in the reverse movement rotation region, the following structure may be possible. Specifically, the response characteristics of the output (torque) generated by the power source may be different according to the rotational operation angle of the accelerator grip in the case of rotating the accelerator grip in the direction Y2 and in the case of rotating the accelerator grip in the direction Y1. More specifically, the amount of torque generated from the power source that has a non-linear relationship with the rotation angle of the accelerator grip may be different in in the case of rotating the accelerator grip in the direction Y2 and in the case of rotating the accelerator grip in the direction Y1, as shown in a graph (a graph showing the relationship between the rotational operation angle of the accelerator grip and the torque generated from the power source according to the rotational operation angle of the accelerator grip) in FIG. 17. In this case, the power source is more responsive to the rotational operation angle of the accelerator grip in the direction Y2 than that in the direction Y1 such that the user easily recognizes whether the accelerator grip has rotated into the forward movement rotation region or the reverse movement rotation region due to the difference in the rotational operation angle of the accelerator grip.

While the neutral rotation region 930*i* is provided at the position offset in the extensional direction of the rotation axis A3 with respect to the forward movement rotation region 910 and the reverse movement rotation region 920 in the aforementioned third embodiment, the present invention is not restricted to this. According to the present invention, no neutral rotation region may be provided at the position offset in the extensional direction of the rotation axis with respect to the forward movement rotation region and the reverse movement rotation region.

While the accelerator grip 82 is not switched from the rotationally operable state in the forward movement rotation region 910 to the rotationally operable state in the reverse movement rotation region 920 unless the accelerator grip 82 goes through the axis movement region 930, and the accelerator grip 82 is switched from the rotationally operable state in the reverse movement rotation region 920 to the rotationally operable state in the forward movement rotation region 910 without going through the axis movement region 930 if the accelerator grip 82 goes through the detour region 940 in the aforementioned fourth embodiment, the present invention is not restricted to this. According to the present invention, the accelerator grip may not be switched from the rotationally operable state in the reverse movement rotation region to the rotationally operable state in the forward movement rotation region unless the accelerator grip goes through the axis movement region, and the accelerator grip may be switched from the rotationally operable state in the forward movement rotation region to the rotationally operable state in the reverse movement rotation region without going through the axis movement region if the accelerator grip goes through the detour region.

What is claimed is:

1. A marine propulsion device comprising:

a power source generating a forward drive force for moving the marine propulsion device in a forward movement direction, and a reverse drive force for moving the marine propulsion device in a reverse movement direction;

a steering handle that extends further forward with respect to the power source;

an accelerator grip movably mounted on the steering handle, a movement region of the accelerator grip including:

a forward movement rotation region where the accelerator grip is operated to rotate about a rotation axis to cause the power source to generate the forward drive force, a reverse movement rotation region where the accelerator grip is operated to rotate about the rotation axis to cause the power source to generate the reverse drive force, and an axis movement region, provided between the forward movement rotation region and the reverse movement rotation region, where the accelerator grip is moved in an extensional direction of the rotation axis;

a shaft member connected to the accelerator grip, the shaft member including a first engaging portion; and a steering handle housing that supports the shaft member, the steering handle housing including a second engaging portion that engages with the first engaging portion, wherein in a state in which the first engaging portion of the shaft member and the second engaging portion of the steering handle housing engage with each other, the accelerator grip is movable to the axis movement region, the forward movement rotation region and the reverse movement rotation region, and wherein the second engaging portion includes:

an axis guide portion that guides movement of the first engaging portion with respect to the steering handle in the extensional direction of the rotation axis, a forward movement rotation guide portion that is connected continuously to one edge portion of the axis guide portion and that guides rotation of the first engaging portion with respect to the steering handle about the rotation axis, and a reverse movement rotation guide portion that is connected continuously to the other edge portion of the axis guide portion and that guides rotation of the first engaging portion with respect to the steering handle about the rotation axis.

2. The marine propulsion device according to claim 1, wherein the forward movement rotation region and the reverse movement rotation region are arranged at positions different from each other in the extensional direction of the rotation axis.

3. The marine propulsion device according to claim 1, wherein the axis movement region includes a neutral region where no drive force is generated in the forward movement direction and in the reverse movement direction.

4. The marine propulsion device according to claim 1, wherein the forward movement rotation region and the reverse movement rotation region are provided at substantially a same position in the extensional direction of the rotation axis, in the forward movement rotation region, the accelerator grip moves in a first rotation direction to move away from a rotation starting point of the accelerator grip in the forward movement rotation region, in the reverse movement rotation region, the accelerator grip moves in a second rotation direction to move away from a rotation starting point of the accelerator grip in the reverse movement rotation region, the first and second rotation directions being opposite from each other, and the accelerator grip is switched from a rotationally operable state in the forward movement rotation region to a rotationally operable state in the reverse movement rotation region through the axis movement region.

5. The marine propulsion device according to claim 4, wherein the forward movement rotation region and the reverse movement rotation region are separated from each other by the axis movement region.

6. The marine propulsion device according to claim 5, wherein the axis movement region includes a neutral rotation region offset in the extensional direction of the rotation axis with respect to the forward movement rotation region and the reverse movement rotation region, the accelerator grip is switched from the rotationally operable state in the forward movement rotation region to the rotationally operable state in the reverse movement rotation region through the neutral rotation region.

7. The marine propulsion device according to claim 1, wherein the accelerator grip is switched from a rotationally operable state in the forward movement rotation region to a rotationally operable state in the reverse movement rotation region through the axis movement region, and the accelerator grip is switched from the rotationally operable state in the reverse movement rotation region to the rotationally operable state in the forward movement rotation region not through the axis movement region.

8. The marine propulsion device according to claim 7, wherein said movement region of the accelerator grip further includes a detour region, and the accelerator grip is switched from the rotationally operable state in the reverse movement rotation region to the rotationally operable state in the forward movement rotation region through the detour region.

9. The marine propulsion device according to claim 8, wherein the accelerator grip is switched from the rotationally operable state in the forward movement rotation region to the rotationally operable state in the reverse movement rotation region through the axis movement region.

10. The marine propulsion device according to claim 1, wherein a maximum rotational operation angle of the accelerator grip in the forward movement rotation region is larger than a maximum rotational operation angle of the accelerator grip in the reverse movement rotation region.

11. The marine propulsion device according to claim 1, wherein the axis movement region includes a neutral region where no drive force in the forward movement direction is generated and no drive force in the reverse movement direction is generated, the marine propulsion device further comprises an urging member that urges the accelerator grip so as to locate the accelerator grip in the neutral region.

12. The marine propulsion device according to claim 1, wherein the power source is an electric motor.

13. The marine propulsion device according to claim 1, wherein in the state where the first engaging portion of the shaft member and the second engaging portion of the steering handle housing engage with each other, the shaft member moves in the extensional direction of the rotation axis with respect to the steering handle housing in a first engaging region that corresponds to the axis movement region, the shaft member rotates about the rotation axis with respect to the steering handle housing in a second engaging region that corresponds to the forward movement rotation region, and the shaft member rotates about the rotation axis with respect to the steering handle housing in a third engaging region that corresponds to the reverse movement rotation region.

14. The marine propulsion device according to claim 13, wherein the second engaging region is formed on a side of the first engaging region that is opposite from a side of the first engaging region that the third engaging region is formed upon.

15. The marine propulsion device according to claim 13, wherein the second and third engaging regions are each perpendicular to the first engaging region.

16. The marine propulsion device according to claim 1, further comprising an engine control unit (ECU) that controls an operation of the power source based upon the accelerator grip so that the power source does not generate any driving force, generates the forward drive force, or generates the reverse drive force, the ECU controlling the operation based upon whether the accelerator grip is in the forward movement rotation region, the reverse movement rotation region or the axis movement region.

17. The marine propulsion device according to claim 1, wherein as viewed in the extensional direction of the rotation axis, the forward movement rotation region and the reverse movement rotation region are arranged so as to overlap each other, and in the forward movement rotation region, the accelerator grip moves in a first rotation direction to move away from a rotation starting point of the accelerator grip in the forward movement rotation region, in the reverse movement rotation region, the accelerator grip moves in a second rotation direction to move away from a rotation starting point of the accelerator grip in the reverse movement rotation region, the first and second rotation directions being opposite from each other.

18. The marine propulsion device according to claim 17, wherein as viewed in the extensional direction of the rotation axis, the forward movement rotation region and the reverse movement rotation region are arranged so as to overlap each other, and in the forward movement rotation region, the accelerator grip moves in a rotation direction to move away from a rotation starting point of the accelerator grip in the forward movement rotation region, in the reverse movement rotation region, the accelerator grip moves in the rotation direction to move away from a rotation starting point of the accelerator grip in the reverse movement rotation region.

19. A marine propulsion device comprising:

a power source generating a forward drive force for moving the marine propulsion device in a forward movement direction, and a reverse drive force for moving the marine propulsion device in a reverse movement direction;

an accelerator grip being rotatable about and movable along a rotation axis, a movement region of the accelerator grip including a forward movement rotation region in which the accelerator grip rotates about the rotation axis to cause the power source to generate the forward drive force, a reverse movement rotation region in which the accelerator grip rotates about the rotation axis to cause the power source to generate the reverse drive force, and an axis movement region, provided between the forward movement rotation region and the reverse movement rotation region, in which the accelerator grip moves along the rotation axis;

a shaft member connected to the accelerator grip, the shaft member including a first engaging portion; and a steering handle housing that supports the shaft member, the steering handle housing including a second engaging portion that engages with the first engaging portion, wherein in a state where the first engaging portion of the shaft member and the second engaging portion of the steering handle housing engage with each other, the accelerator grip is movable to the axis movement region, the forward movement rotation region and the reverse movement rotation region, and wherein the second engaging portion includes:

an axis guide portion that guides movement of the first engaging portion with respect to the steering handle in the extensional direction of the rotation axis, a forward movement rotation guide portion that is connected continuously to one edge portion of the axis guide portion and guides rotation of the first engaging portion with respect to the steering handle about the rotation axis, and a reverse movement rotation guide portion that is connected continuously to other edge portion of the axis guide portion and guides rotation of the first engaging portion with respect to the steering handle about the rotation axis.

20. The marine propulsion device according to claim 19, further comprising an engine control unit (ECU) that controls an operation of the power source based upon the accelerator grip so that the power source does not generate any driving force, generates the forward drive force, or generates the reverse drive force, the ECU controlling the operation based upon whether the accelerator grip is in the forward movement rotation region, the reverse movement rotation region or the axis movement region.

* * * * *